US010145531B2

(12) United States Patent
Leung

(10) Patent No.: US 10,145,531 B2
(45) Date of Patent: Dec. 4, 2018

(54) LIGHT EMITTING DIODE STROBE LIGHTING SYSTEM

(71) Applicant: Huizhou Light Engine Limited, Huizhou (CN)

(72) Inventor: Wa Hing Leung, Hong Kong (CN)

(73) Assignee: Huizhou Light Engine Limited, Huizhou (CN)

( * ) Notice: Subject to any disclaimer, the term of this patent is extended or adjusted under 35 U.S.C. 154(b) by 131 days.

(21) Appl. No.: 15/349,564

(22) Filed: Nov. 11, 2016

(65) Prior Publication Data

US 2017/0138563 A1 May 18, 2017

Related U.S. Application Data

(60) Provisional application No. 62/255,093, filed on Nov. 13, 2015.

(51) Int. Cl.
*F21V 5/00* (2018.01)
*G08B 5/38* (2006.01)
(Continued)

(52) U.S. Cl.
CPC ..... *F21V 5/007* (2013.01); *F21V 5/04* (2013.01); *F21V 5/045* (2013.01); *F21V 15/01* (2013.01); *G08B 5/38* (2013.01); *F21V 23/003* (2013.01); *F21V 33/0076* (2013.01); *F21Y 2113/13* (2016.08); *F21Y 2115/10* (2016.08); *G08B 17/00* (2013.01); *H04R 1/028* (2013.01)

(58) Field of Classification Search
CPC . F21V 15/01; F21V 5/04; F21V 5/045; F21V 5/007
See application file for complete search history.

(56) References Cited

U.S. PATENT DOCUMENTS 6,217,196 B1 4/2001 Kosich et al.
6,739,738 B1 5/2004 Smith
(Continued)

FOREIGN PATENT DOCUMENTS

CN 201177211 Y 1/2009
CN 201531823 U 7/2010
(Continued)

OTHER PUBLICATIONS

Search Report dated Nov. 17, 2016 for Chinese Patent Application No. 201610998123.8.
(Continued)

*Primary Examiner* — Anabel Ton
(74) *Attorney, Agent, or Firm* — Duane Morris LLP

(57) ABSTRACT

A lens and strobe light system are provided. The lens can include a base defining a cavity configured to accept one or more light sources. The lens can further include one or more lens segments disposed on the base. The one or more lens segments can be configured to direct light emitted from the one or more light sources out from the lens. The strobe light system can include a plurality of light sources, a plurality of lenses disposed on the plurality of light sources, and a controller configured to control the operation of the plurality of light sources. The plurality of lenses can be configured to direct light emitted from the plurality of light sources out from the strobe light system.

29 Claims, 29 Drawing Sheets

(51) Int. Cl.

| | |
|---|---|
| ***F21V 5/04*** | (2006.01) |
| ***F21V 15/01*** | (2006.01) |
| *F21Y 113/13* | (2016.01) |
| *F21Y 115/10* | (2016.01) |
| *F21V 23/00* | (2015.01) |
| *F21V 33/00* | (2006.01) |
| *G08B 17/00* | (2006.01) |
| *H04R 1/02* | (2006.01) |

(56) References Cited

U.S. PATENT DOCUMENTS

| | | | | |
|---|---|---|---|---|
| 6,789,930 | B2 * | 9/2004 | Pederson | B60Q 1/2611 362/545 |
| 7,907,047 | B2 | 3/2011 | Curran et al. | |
| 9,689,554 | B1 * | 6/2017 | Householder | F21V 5/08 |
| 9,752,751 | B2 * | 9/2017 | Yu | F21V 5/045 |
| 9,835,309 | B2 * | 12/2017 | Cho | F21V 5/08 |
| 9,939,128 | B2 * | 4/2018 | Tsai | F21V 5/045 |
| 2003/0031028 | A1 | 2/2003 | Murray et al. | |
| 2013/0147347 | A1 * | 6/2013 | Laporte | F21V 5/007 313/512 |
| 2014/0063802 | A1 * | 3/2014 | Garcia | F21V 5/007 362/241 |

FOREIGN PATENT DOCUMENTS

| | | | |
|---|---|---|---|
| CN | 201621617 | U | 11/2010 |
| CN | 201765668 | U | 3/2011 |
| CN | 102269385 | A | 12/2011 |
| CN | 103017039 | A | 4/2013 |
| CN | 202993058 | U | 6/2013 |
| CN | 103277740 | A | 9/2013 |
| CN | 203231239 | U | 10/2013 |
| CN | 203273673 | U | 11/2013 |
| CN | 203336472 | U | 12/2013 |
| CN | 103629622 | A | 3/2014 |
| CN | 103883888 | A | 6/2014 |
| WO | WO-2015110392 | A1 | 7/2015 |

OTHER PUBLICATIONS

International Search Report dated Feb. 9, 2017 for PCT International Application No. PCT/IB2016/056823.

Bullough, J.D. & Zhu, Y., "Performance Objectives for Light Sources Used in Emergency Notification Appliances," The Fire Production Research Foundation , Lighting Research Center, Rensselaer Polytechnic Institute (May 2012).

Bullough, J.D. et al., "Parameters for Indirect Viewing of Visual Signals Used in Emergency Notification," The Fire Production Research Foundation, Lighting Research Center, Rensselaer Polytechnic Institute (Sep. 2013).

Bullough, John D., Ph.D., "Parameters for Indirect Viewing of Visual Signals Used in Emergency Notification: Part I. Study Results", SUPDET Conference 2014, Orlando, FL (Mar. 4-7, 2014).

Savage, Ken, "Human Factors Comparison of Detectability for LED and Xenon Tube Light Sources for Fire Alarm Notification Strobes", TYCO Safety Products, Rev. 4.4 (Sep. 1, 2010).

Savage, Ken, "Flash Pusle (sp) Width Effectiveness in Notification Appliances," TYCO Safety Products (Jan. 25, 2011).

Siu, Johnny K,W., Ph.D, "Design Considerations of LED based Visible Notification Appliances", SUPDET Conference 2015, Orlando, FL (Mar. 3-6, 2015).

Stich, Andreas & Huber, Rainer, "Thermal Consideration of Flash LEDs," Osram Opto Semiconductors Application Note (Dec. 2014).

"Pulsed Over Current Driving of Cree® XLamp® LEDs: Information and Cautions," Cree Application Note, CLD-AP60 REV 1A (2014).

* cited by examiner

A-A, A'-A'

X-X, Y-Y

B-B

A-A, A'-A'

LIGHT EMITTING DIODE STROBE LIGHTING SYSTEM

CROSS REFERENCE TO RELATED APPLICATIONS

This patent application claims the benefit of U.S. Provisional Patent Application No. 62/255,093, filed Nov. 13, 2015, entitled "LIGHT EMITTING DIODE STROBE LIGHTING SYSTEM," which is incorporated herein by reference in its entirety. Also, certain references, standards and/or products are cited in this patent application, and such references, standards and/or products are incorporated herein by reference in its entirety.

TECHNICAL FIELD

The present disclosure relates generally to strobe light systems, including strobe light systems that include light emitting diodes ("LEDs").

BACKGROUND

Strobe lighting or stroboscopic lamp systems include light sources configured to have relatively short duration, high peak intensity flashing lights. Conventional incandescent or LED strobe light or stroboscopic lamp systems are commonly used in a variety of indoor and outdoor emergency lighting aids to increase visibility and communication at night or when conditions, such as power outages, water immersion and smoke caused by fires and chemical fog, render normal ambient lighting insufficient for visibility. Strobe light systems can also be used in, for example, emergency vehicles and aircraft anti-collision lighting systems both on aircraft themselves and also on stationary objects (e.g., tall buildings, radio towers, etc.).

Conventional LEDs consume less power, exhibit a longer lifespan, are relatively inexpensive to manufacture, and are easier to install when compared to incandescent light bulbs. More increasingly, LEDs are used as viable replacements for incandescent light sources in strobe lighting or stroboscopic lamp systems.

Strobe lighting systems can be designed to comply with one or more standards, including Underwriters Laboratories' (UL) "Standard for Signaling Devices for the Hearing Impaired—UL 1971." The UL 1971 standard defines parameters for signaling devices, including, for example, flash/pulse rate, flash/pulse duration, luminous intensity, color, etc. The UL 1971 standard is incorporated herein by reference in its entirety.

Strobe light systems including LEDs typically require the LEDs to be driven at large voltage and/or currents to meet the design standards (e.g., UL 1971), resulting in reduced efficiency of the LEDs. Accordingly, there exists a need to provide an LED strobe light system that can produce strobe lighting that complies with design standards while operating the LEDs with increased efficiency (e.g., reduced power consumption).

BRIEF SUMMARY

In consideration of the above problems, in accordance with one aspect disclosed herein, a lens is provided. In an exemplary embodiment, the lens includes a base defining a cavity configured to accept one or more light sources; and one or more lens segments disposed on the base. The one or more lens segments can be configured to direct light emitted from the one or more light sources out from the lens. The one or more light sources can be one or more LED light sources.

In an exemplary embodiment, the one or more lens elements are angularly positioned on the base with respect to an optical axis of the one or more light sources.

In an exemplary embodiment, each of the one or more lens elements comprise an arced portion and linear portion, wherein the linear portion extends radially outward from the one or more light sources and meets the arced portion.

In an exemplary embodiment, the one or more lens elements comprise a first lens element and a second lens element, wherein the first and the second lens elements are angularly positioned on the base with respect to each other and to an optical axis of the one or more light sources.

In an exemplary embodiment, the one or more lens elements comprise a first lens element and a second lens element, wherein the linear portion of the first lens element and the linear portion of the second lens element define an angle formed therebetween.

In an exemplary embodiment, the angle is 30 to 50 degrees.

In an exemplary embodiment, the angle is substantially 44 degrees.

In an exemplary embodiment, the lens further comprises one or more recessed portions that each extend laterally inward towards the cavity.

In accordance with another aspect disclosed herein, a strobe light system is provided. In an exemplary embodiment, the strobe light system includes a plurality of light sources, a plurality of lenses disposed on the plurality of light sources, and a controller configured to control the operation of the plurality of light sources. The plurality of light sources can be a plurality of LEDs light sources.

In an exemplary embodiment, each lens of the strobe light system has a same design.

In an exemplary embodiment, the plurality of lenses comprises lenses of different designs.

In an exemplary embodiment, the plurality of lenses are configured to direct light emitted from the plurality of light sources out from the strobe light system.

In an exemplary embodiment, the plurality of lenses comprises first, second, third, fourth, and fifth lenses configured in a star arrangement.

In an exemplary embodiment, the plurality of lenses comprises first, second, third, fourth, and fifth lenses configured in a substantially semicircular arrangement.

In an exemplary embodiment, the first lens is arranged in a first direction; the fourth lens is arranged in a second direction opposite the first direction; the second lens is arranged in a third direction that forms a first angle with respect to the first direction; the third lens is arranged in a fourth direction that forms a second angle with respect to the second direction; and the fifth lens is arranged substantially perpendicular to the first direction.

In an exemplary embodiment, the first and second angles are equal.

In an exemplary embodiment, the first and second lenses are symmetrically arranged with respect to the fourth and third lenses, respectively, and the fifth lens is arranged along the axis of symmetry.

In an exemplary embodiment, the fifth lens is disposed between the first and fourth lenses in a plane, wherein the first and fourth directions extend in the plane.

In an exemplary embodiment, the plurality of light sources and the plurality of lenses are configured to cooperatively generate light having a pulse rate and luminous intensity that comply with the Underwriters Laboratories UL 1971 Standard.

In an exemplary embodiment, the plurality of lenses is configured in a substantially circular arrangement.

In an exemplary embodiment, the plurality of lenses comprises first, second, third, fourth, fifth, sixth, seventh, and eighth lenses configured in a substantially circular arrangement.

In an exemplary embodiment, immediately adjacent lenses of the plurality of lenses form a substantially 45 degree angle therebetween.

In an exemplary embodiment, the plurality of lenses comprise first, second, third, and fourth lenses configured in a circular arrangement, and a fifth lens arranged substantially in a center of the circular arrangement.

In an exemplary embodiment, the first, the second, the third, and the fourth lenses comprises a first lens design and the fifth lens comprises a second lens design different from the first lens design.

In an exemplary embodiment, wherein the first, the second, the third, and the fourth lenses are arranged 90 degrees or substantially 90 degrees apart along the circular arrangement.

In an exemplary embodiment, the first, the second, the third, and the fourth lenses are arranged at 0, 90, 180, and 270 degrees along the circular arrangement, respectively.

In an exemplary embodiment, the first, the second, the third, and the fourth lenses are configured to direct light emitted from corresponding ones of the plurality of light sources at 0, 90, 180, and 270 degrees with respect to the circular arrangement.

In an exemplary embodiment, the fifth lens is configured to direct light emitted from a corresponding one of the plurality of light sources at 45, 135, 225, and 315 degrees with respect to the circular arrangement.

In an exemplary embodiment, the one or more lens segments are disposed in a circular arrangement around the base to form the lens having a dome-shaped lens structure.

In an exemplary embodiment, the one or more lens elements are angularly positioned on the base with respect to an optical axis of the one or more light sources.

In an exemplary embodiment, each of the one or more lens elements extend from the base and meet a crown of the lens to form the lens having a dome-shaped lens structure.

In an exemplary embodiment, each of the one or more lens elements form convex lens structure.

BRIEF DESCRIPTION OF THE FIGURES

The accompanying figures, which are incorporated herein and form a part of the specification, illustrate the embodiments of the present disclosure and, together with the description, further serve to explain the principles of the embodiments and to enable a person skilled in the pertinent art to make and use the embodiments. The figures are for illustration purposes only and are not necessarily drawn to scale.

The exemplary embodiments of the present disclosure will be described with reference to the accompanying drawings. The drawing in which an element first appears is typically indicated by the leftmost digit(s) in the corresponding reference number.

DETAILED DESCRIPTION

Figure 1A:
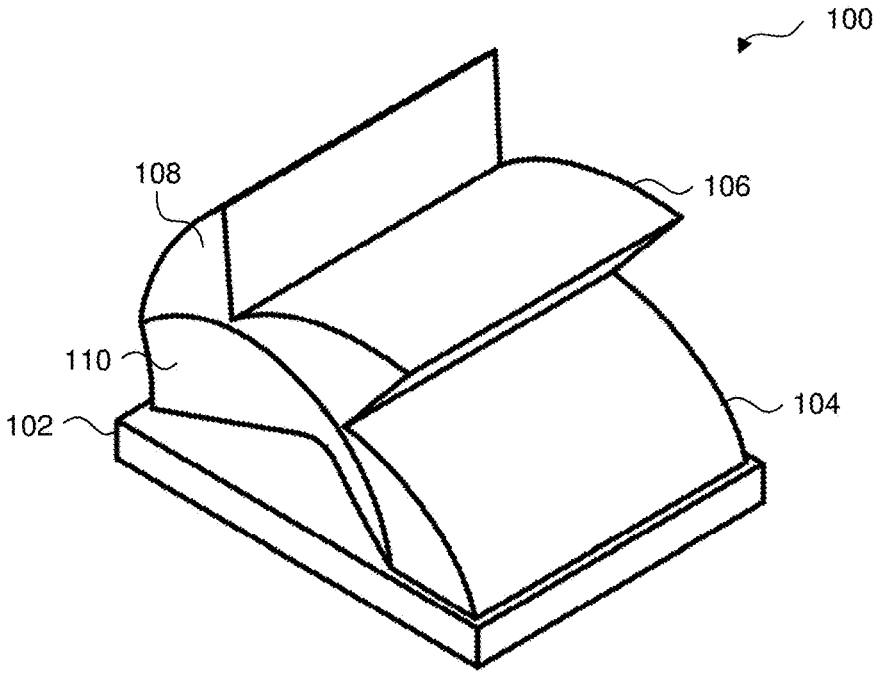
FIG. 1A illustrates a top front left prospective view of a lens according to an exemplary embodiment of the present disclosure.
Figure 1B:
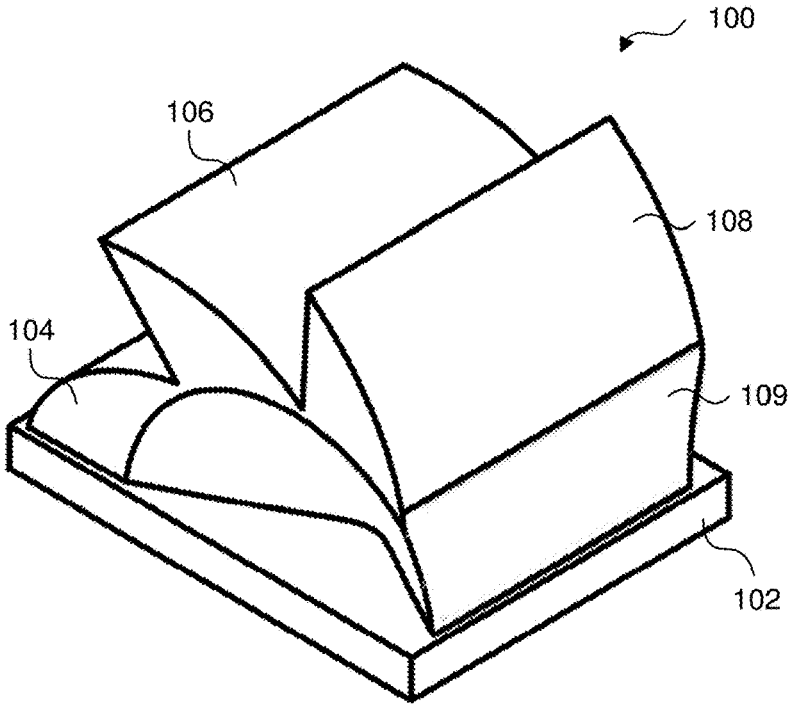
FIG. 1B illustrates a top back right prospective view of the lens of FIG. 1A.
Figure 1C:
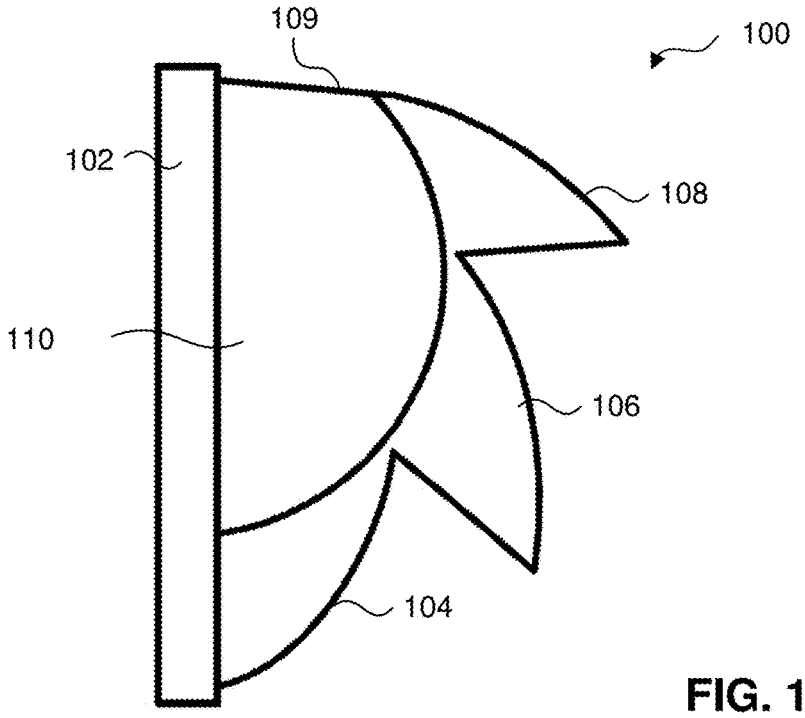
FIG. 1C illustrates a left side elevation view of the lens of FIG. 1A.

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

FIGS. 1A-1J illustrate a lens 100 according to an exemplary embodiment of the present disclosure. The lens 100 can include a base 102 that supports one or more lens elements or segments. For example, the lens 100 can include three lens elements 104, 106, and 108, but is not limited thereto. The lens element 108 can meet a back portion 109 of the lens 100 that extends from the base 102. In an exemplary embodiment, the lens elements 104, 106 and 108 can be Fresnel lens elements/segments similar to those of a Fresnel lens. Further, the lens 100 can include recessed portions 110 on the left and the right sides of the lens 100 as illustrated in FIGS. 1A-1C, 1E, 1G, 1I, and 1J. The lens 100 can be formed of one or more transparent or translucent materials. In an exemplary embodiment, the lens 100 is formed of polycarbonate, but is not limited thereto and the lens 100 can be formed of other materials as would be understood by one of ordinary skill in the art.

Figure 1D:
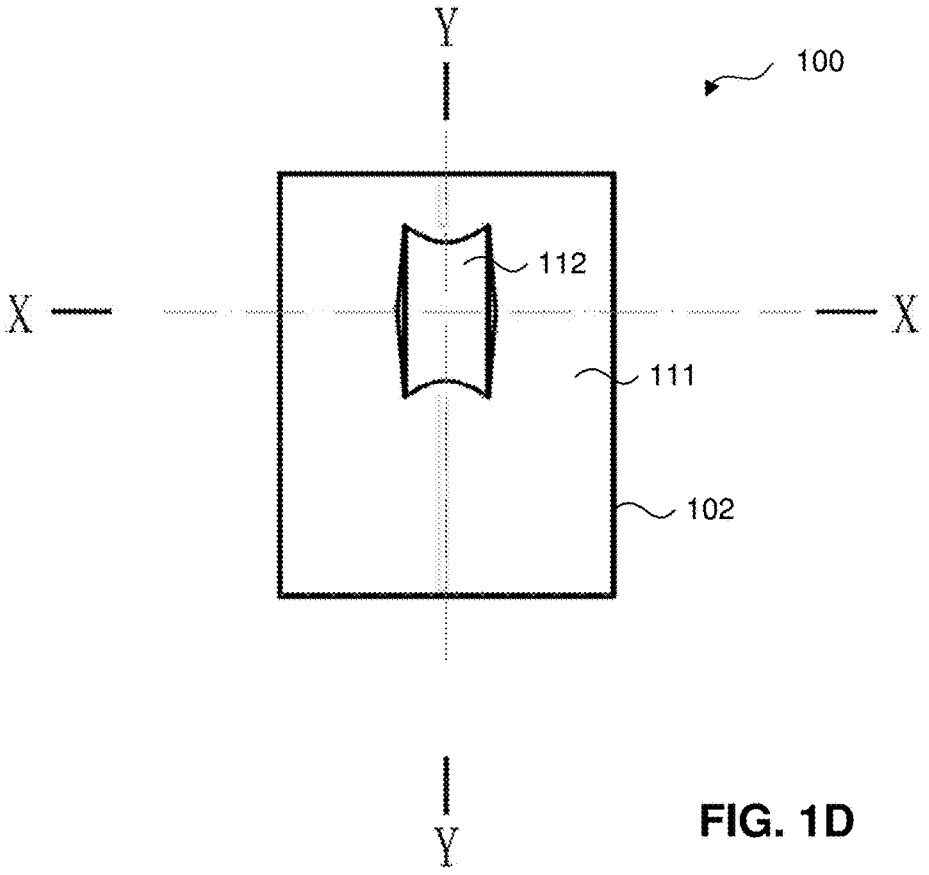
FIG. 1D illustrates a bottom view of the lens of FIG. 1A.
Figure 1E:
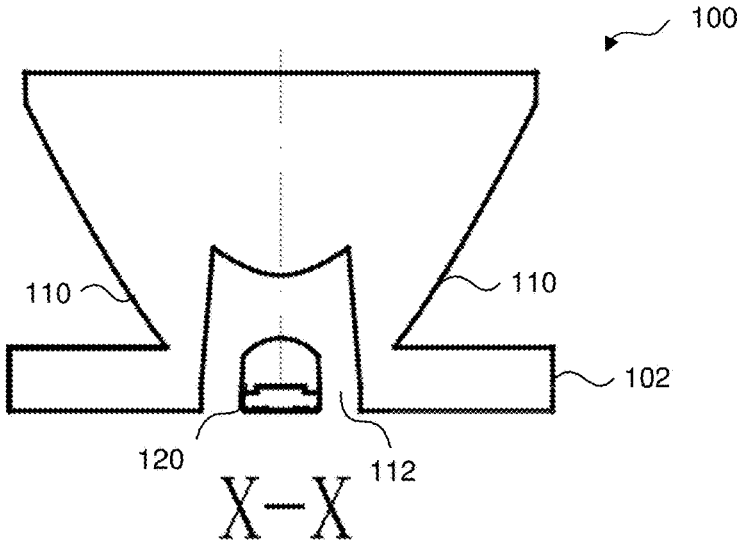
FIG. 1E illustrates a cross-sectional view taken along X-X in FIG. 1D.

With reference to FIG. 1D, the bottom 111 of the lens 100 can include an opening to a cavity 112. The cavity 112 can be configured to receive and house one or more light sources, such as LED light source 120 as illustrated in FIGS. 1E-1H and 1J. The LED light source 120 can include one or more LEDs that are configured to emit one or more colors. For example, the LED light source 120 can include one or more white LEDs. The LED light source 120 can include a plurality of LEDs such as red, green and/or blue ("RGB") LEDs whose output can be controlled such that the RGB components mix according to known principles to create any visible color (including black and white). In an exemplary embodiment, the LED light source 120 can be model "LED2245 PC" produced by Bayer MaterialScience (also known as Bayer Covestro), but is not limited thereto. In another exemplary embodiment, the LED light source 120 can be a Cree's High-Density Discrete LED model "XLamp XB-H."

In an exemplary embodiment, the LED light source 120 and corresponding lens 100 can be configured to emit pulsed light at a pulse rate and luminous intensity that comply with the UL 1971 standard. For example, the lighting system (e.g., light source 120 and lens 100) can generate a luminous intensity of approximately 260 candela (cd) with a luminous flux of approximately 96 lumen (lm) (e.g., approximately 2.7 cd/lm), but is not limited to these values. In an exemplary embodiment, the lighting system can be configured to generate light with a pulse rate of, for example, 20 milliseconds (ms), but is not limited thereto.

Figure 1F:
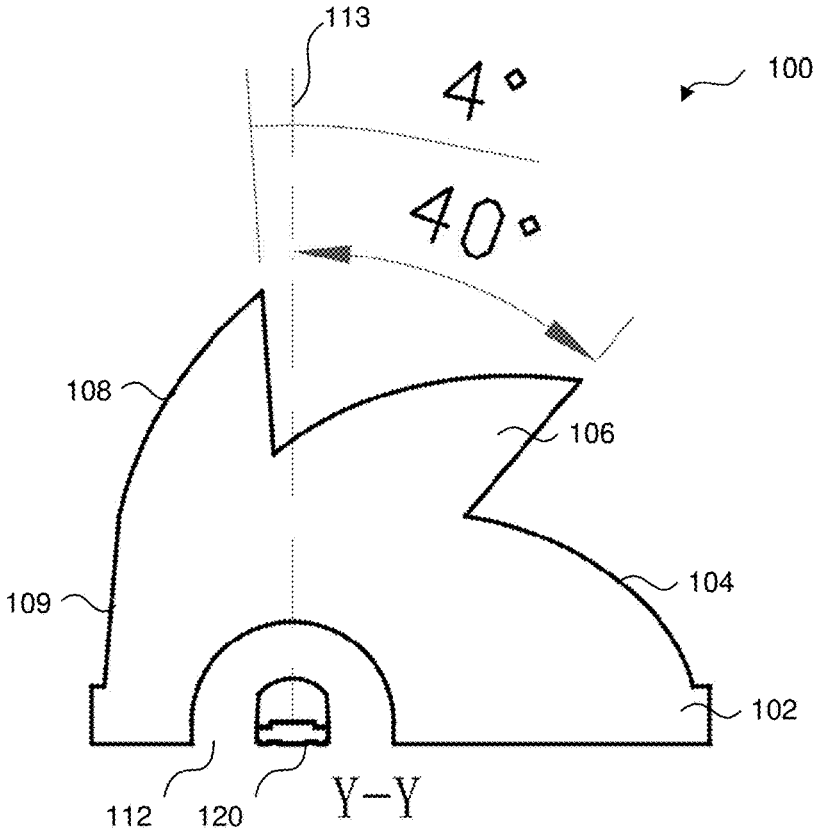
FIG. 1F illustrates a cross-sectional view taken along Y-Y in FIG. 1D.

As illustrated in FIG. 1F, the lens elements 104, 106, and 108 can be angularly positioned along a top surface of the lens 100. In an exemplary embodiment, the linear surface of the lens element 108 and the linear surface of the lens element 106 can form an angle of 44 degrees, where the linear surface of the lens element 108 forms a four degree angle with respect to the optical axis 113. In an exemplary embodiment, the angle formed between the linear surfaces of adjacent lens elements can be within the range of 30 to 50 degrees, but is not limited thereto. The angular configurations are not limited to these exemplary values and the angle between adjacent lens elements and/or the angle between the lens element(s) and the optical axis can be other angular values as would be understood by one of ordinary skill in the relevant arts.

Figure 1G:
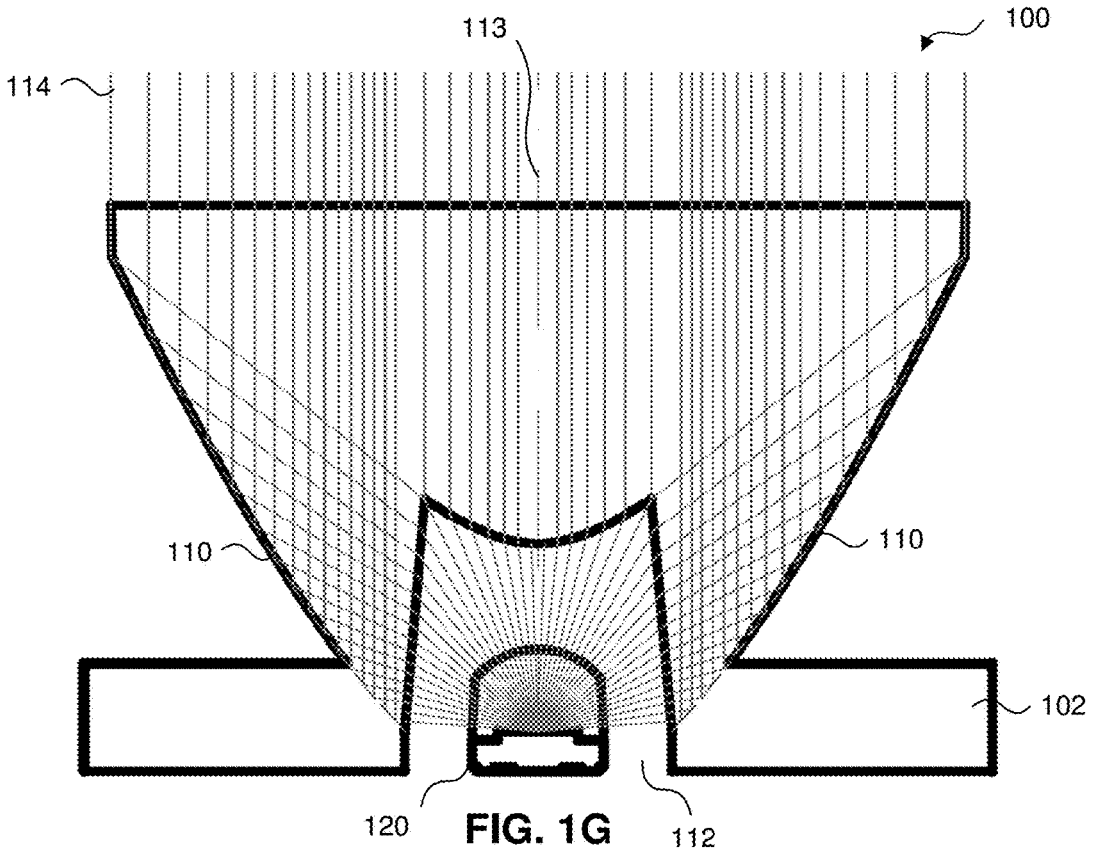
FIG. 1G illustrates a cross-sectional view taken along X-X in FIG. 1D.
Figure 1H:
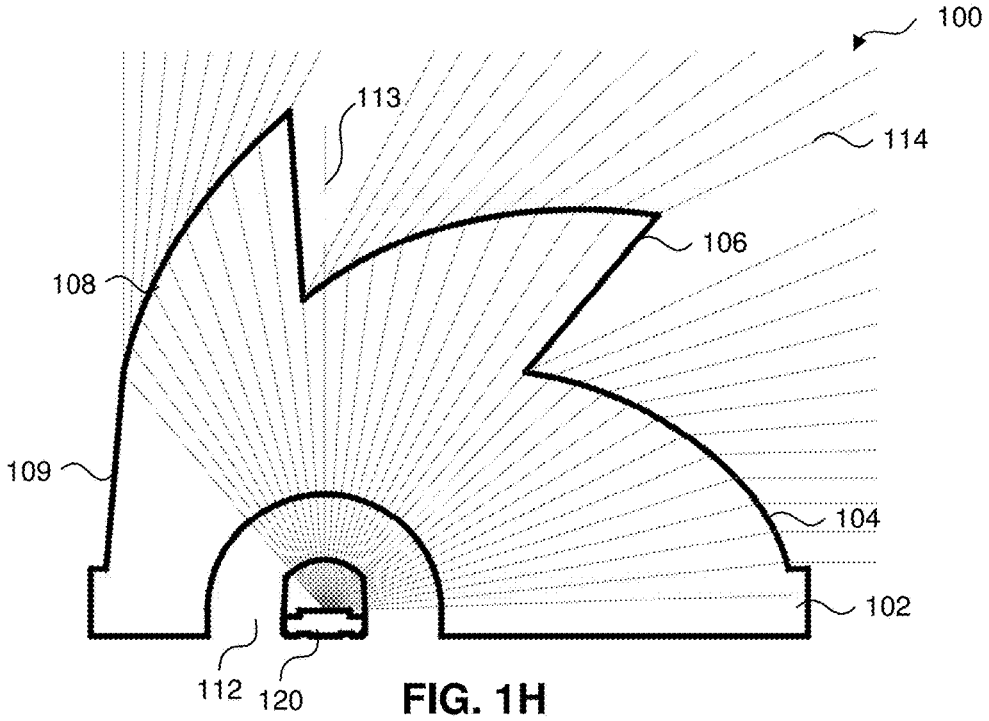
FIG. 1H illustrates a cross-sectional view taken along Y-Y in FIG. 1D.
Figure 1J:
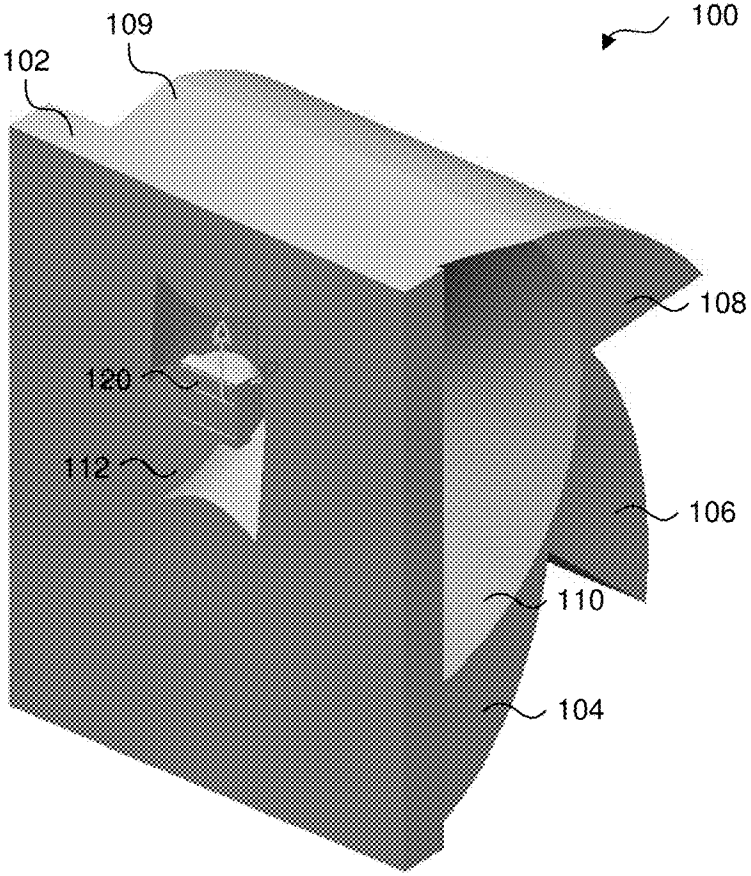
FIG. 1J illustrates a back bottom left prospective view of the lens of FIG. 1A.
Figure 1I:
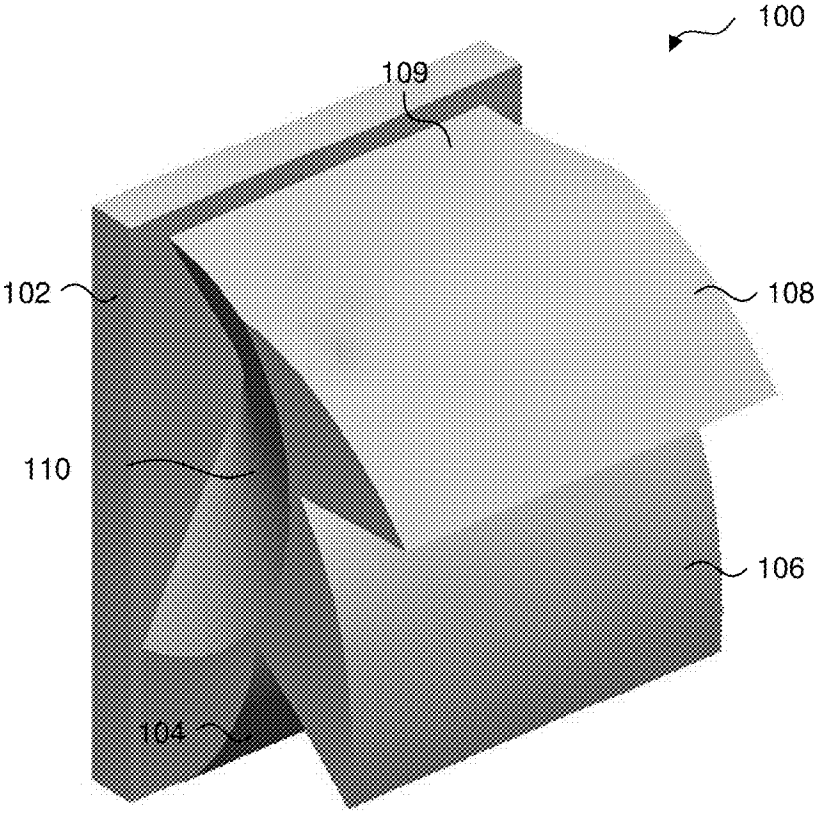
FIG. 1I illustrates a back top left prospective view of the lens of FIG. 1A.

FIGS. 1G and 1H illustrate the light rays 114 that are emitted from the LED light source 120 and pass through and exit the lens elements 104, 106, and 108.

Figure 2A:
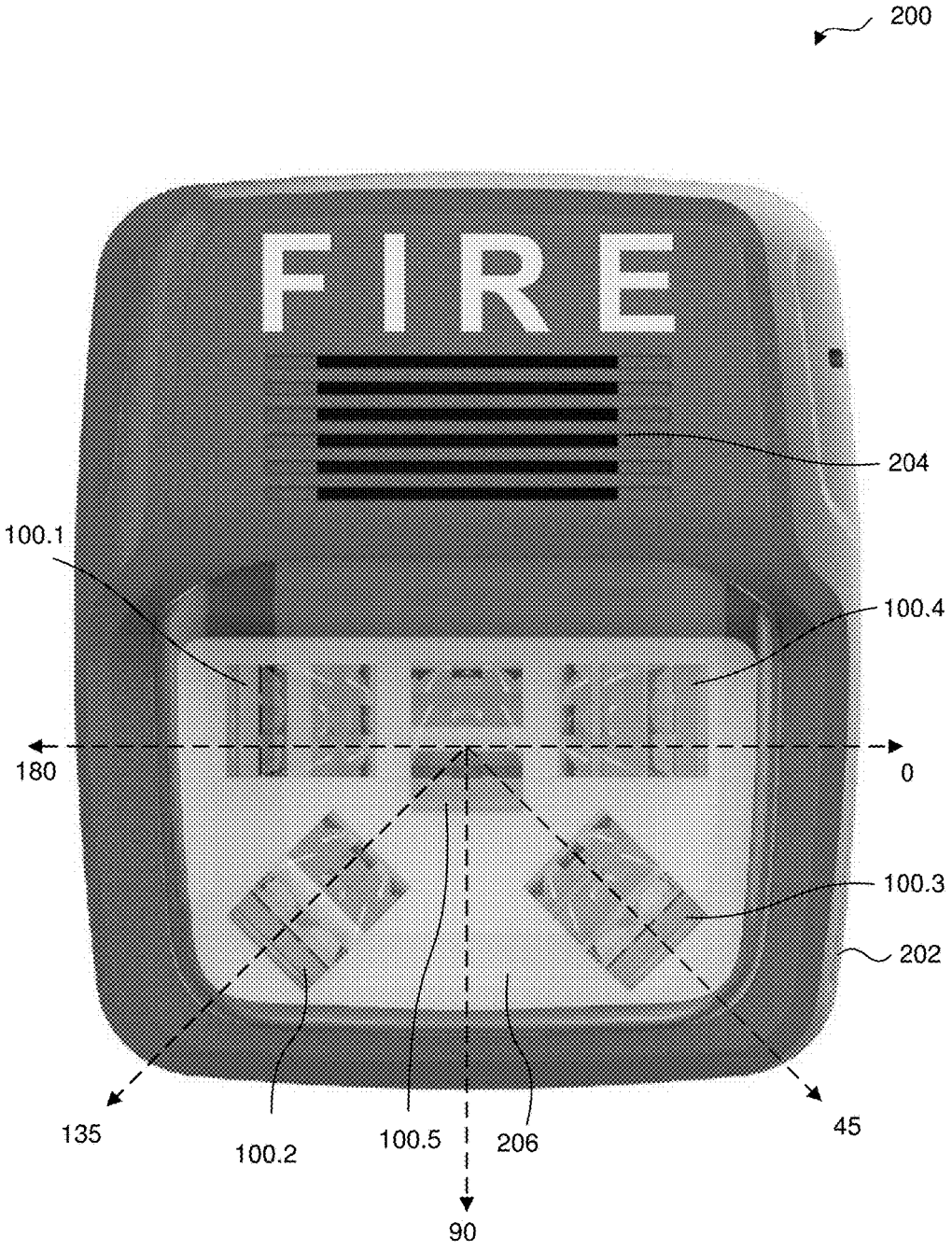
FIG. 2A illustrates a front elevation view of a strobe light system according to an exemplary embodiment of the present disclosure.
Figure 2C:
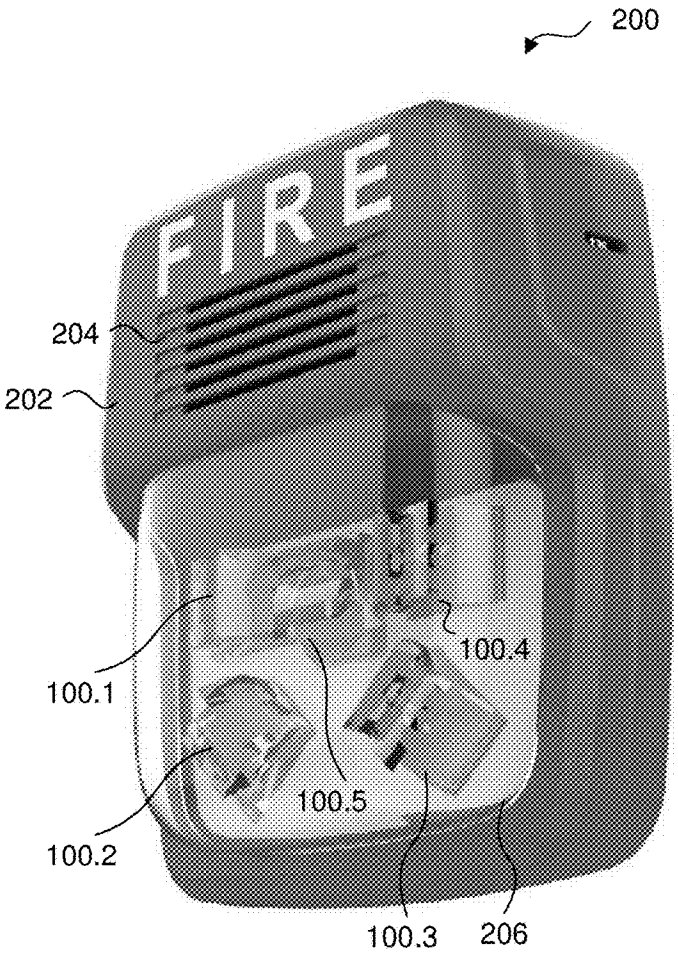
FIG. 2C illustrates a right front prospective view of the strobe light system of FIG. 2A.
Figure 2B:
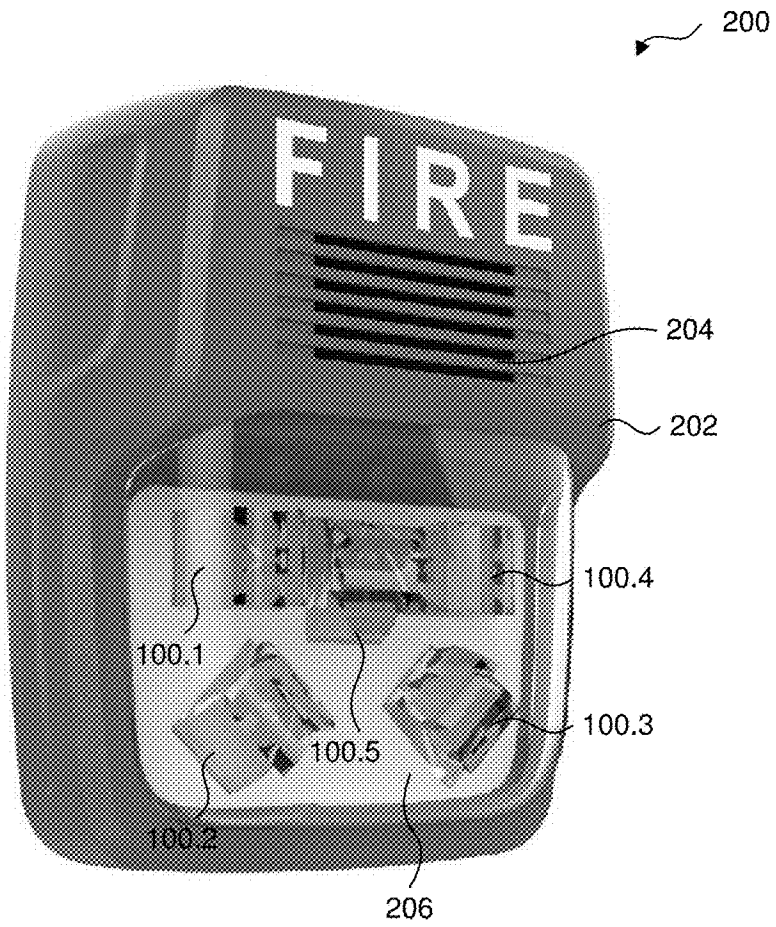
FIG. 2B illustrates a left front prospective view of the strobe light system of FIG. 2A.

FIGS. 2A-2C illustrate a strobe light system 200 according to an exemplary embodiment of the present disclosure. The strobe light system 200 can include one or more light sources and corresponding lenses. For example, the strobe light system 200 can include one or more lenses 100. The strobe light system 200 can include a base 202, where the one or more lenses 100 are formed/disposed thereon, and a speaker 204. The speaker 204 can be configured to output audible sound such as an alarm signal and/or message. The strobe light system 200 can also include a cover 206 that is disposed over the lenses 100. The cover 206 can be, for example, transparent or translucent and configured to protect the lenses 100.

In an exemplary embodiment, the strobe light system 200 includes lenses 100.1 to 100.5 configured in a star arrangement. With reference to FIG. 2A, various axes 0, 45, 90, 135, and 180 are illustrated that extend at 0, 45, 90, 135, and 180 degrees, respectively. In an exemplary embodiment, the lenses 100.1 to 100.5 can be configured along corresponding axes. For example, lenses 100.1 and 100.4 can be arranged in horizontal arrangements at 180 degrees and 0 degrees, respectively. That is, lens 100.1 is arranged along the 180-degree axis and lens 100.4 is arranged along the 0-degree axis. Lenses 100.2 and 100.3 can be arranged in an angular configuration between 0-180 degrees. In an exemplary embodiment, lens 100.3 is arranged at 45 degrees (e.g., along the 45-degree axis), while lens 100.2 is arranged at 135 degrees (e.g., along the 135-degree axis). In this configuration, lenses 100.1 to 100.4 form an arced arrangement from 0-180 degrees. Lens 100.5 is vertically arranged at, for example, 90 degrees (e.g., along the 90-degree axis) and positioned between lenses 100.1 and 100.4 in the horizontal direction. The number of lenses 100 and the angular configurations are not limited to these examples, and the number of lenses 100 and respective angular arrangements can be modified as would be understood by those skilled in the relevant arts.

In an exemplary embodiment, lenses 100.1 and 100.2 are symmetrically arranged with respect to lenses 100.4 and 100.3, respectively. In this example, the lens 100.5 is arranged along an axis of symmetry that extends along the 90-degree axis as illustrated in FIG. 2A. That is, the 90-degree axis illustrated in FIG. 2A can also correspond to the axis of symmetry for a symmetrical arrangement of lenses 100.1 to 100.4. The axis of symmetry is not limited to the arrangement along the 90-degree axis and the lenses 100 can be arranged in other symmetrical (or non-symmetrical) arrangements as would be understood by one of ordinary skill in the relevant arts.

In an exemplary embodiment, the strobe light system 200 can be configured to control the LED light sources 120 of corresponding lenses 100.1 to 100.5 to operate with pulse rates and luminous intensities that comply with the UL 1971 standard. For example, the strobe light system 200 can be configured to control the LED light sources 120 to have a pulse rate of 20 milliseconds (ms), but is not limited thereto. In an exemplary embodiment, the strobe light system 200 can be configured to control the LED light sources 120 of the corresponding lenses 100.1 to 100.5 to generate a luminous intensity as illustrated in the plots 700 and 702 of FIGS. 7A and 7B, respectively. For example, the LED light sources 120 and corresponding lenses 100.1 to 100.5 can generate a luminous intensity of approximately 260 candela (cd) with a luminous flux of approximately 381 lumen (lm) (e.g., approximately 0.68 cd/lm), but is not limited to these values.

Figure 3A:
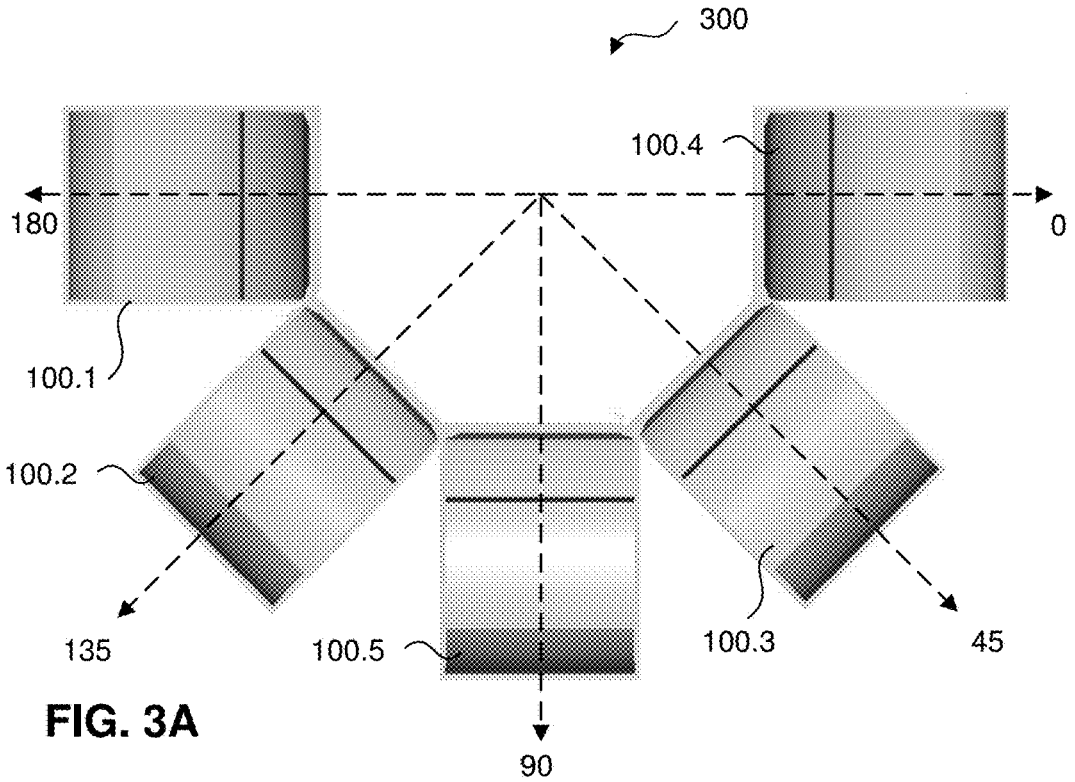
FIG. 3A illustrates a top plan view of a lens system according to an exemplary embodiment of the present disclosure.
Figure 3B:
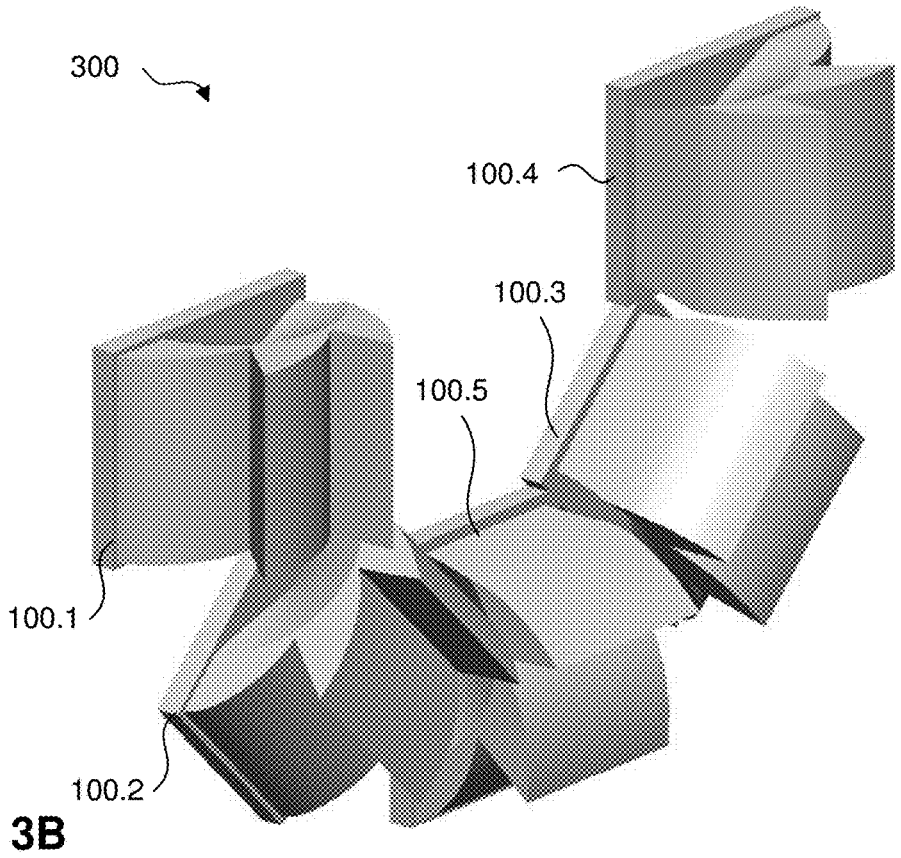
FIG. 3B illustrates a top left prospective view of the lens system of FIG. 3A.
Figure 3C:
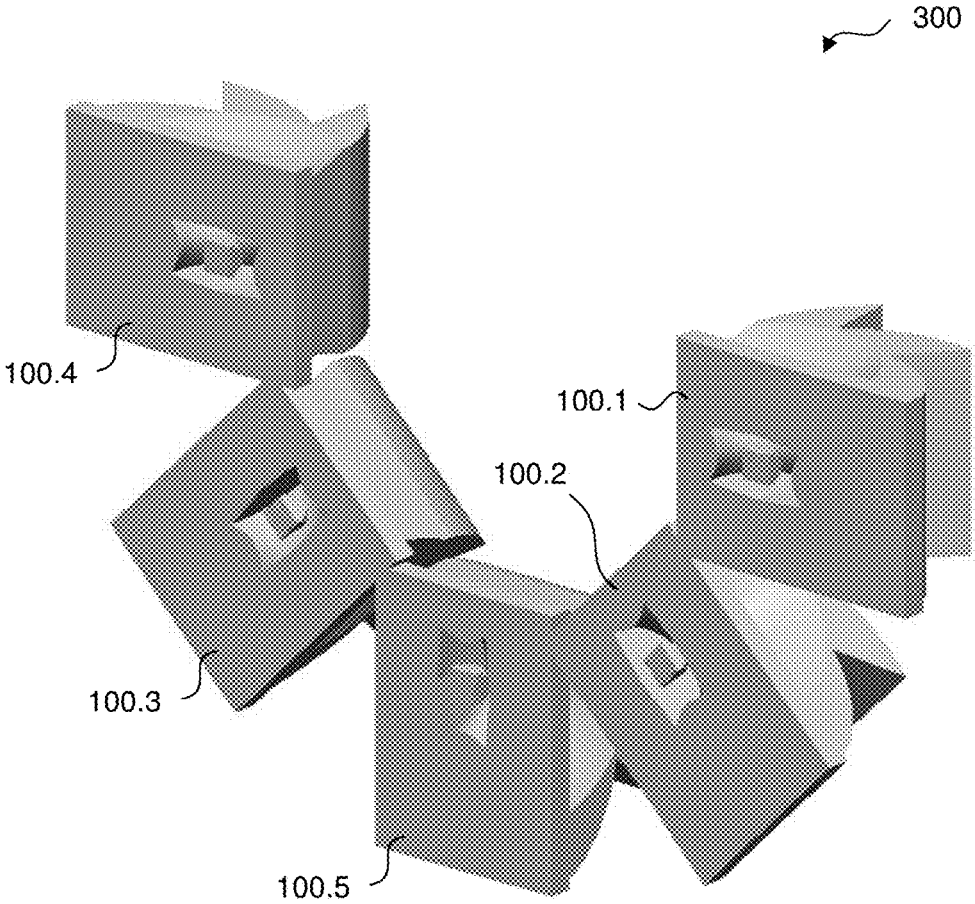
FIG. 3C illustrates a bottom left prospective view of the lens system of FIG. 3A.

FIGS. 3A-3C illustrate a lens system 300 according to an exemplary embodiment of the present disclosure. The lens system 300 can include one or more lenses. For example, as illustrated in FIGS. 3A-3C, the lens system 300 includes five lenses arranged in a semi-circular configuration. In an exemplary embodiment, the lens system 300 can include one or more lenses 100 illustrated in FIGS. 1A-1J. With reference to FIG. 3A, various axes 0, 45, 90, 135, and 180 are illustrated that extend at 0, 45, 90, 135, and 180 degrees, respectively. In an exemplary embodiment, the lenses 100.1 to 100.5 can be configured along corresponding axes. For example, the lens system 300 can include lenses 100.1 and 100.4 arranged in horizontal arrangements at 180 degrees and 0 degrees, respectively. That is, lens 100.1 is arranged along the 180-degree axis and lens 100.4 is arranged along the 0-degree axis. Lenses 100.2 and 100.3 can be arranged in an angular configuration between 0-180 degrees. In an exemplary embodiment, lens 100.3 is arranged at 45 degrees (e.g., along the 45-degree axis), while lens 100.2 is arranged at 135 degrees (e.g., along the 135-degree axis), but are not limited to these angular values. Lens 100.5 is vertically arranged at, for example, 90 degrees (e.g., along the 90-degree axis) and positioned between lenses 100.2 and 100.3. In this configuration, lenses 100.1 to 100.5 form an arced (semi-circular) arrangement from 0-180 degrees. In this example, lens 100.5 is vertically offset from lenses 100.1 and 100.4 as compared to the arrangement illustrated in FIGS. 2A-2C. In an exemplary embodiment, the lenses 100 of the strobe light system 200 can be arranged in the configuration of lenses 100 of lens system 300.

In an exemplary embodiment, the angle formed between two adjacent lenses 100 can be the same or a different angular value as that formed between another adjacent two lenses 100. For example, as illustrated in FIG. 3A, the angle formed by the arrangement of lens 100.1 and lens 100.2 (e.g., 180 degrees−135 degrees=45 degrees) can be equal to the angle formed by the arrangement of lens 100.3 and lens 100.4 (e.g., 45 degrees−0 degrees=45 degrees).

The number of lenses 100 and the angular configurations are not limited to these examples, and the number of lenses 100 and respective angular arrangements can be modified as would be understood by those skilled in the relevant arts.

In an exemplary embodiment, lenses 100.1 and 100.2 are symmetrically arranged with respect to lenses 100.4 and 100.3, respectively. In this example, the lens 100.5 is arranged along an axis of symmetry that extends along the 90 degree axis as illustrated in FIG. 3A. That is, the 90-degree axis illustrated in FIG. 3A can also correspond to the axis of symmetry for a symmetrical arrangement of lenses 100.1 to 100.4. The axis of symmetry is not limited to the arrangement along the 90-degree axis and the lenses 100 can be arranged in other symmetrical (or non-symmetrical) arrangements as would be understood by one of ordinary skill in the relevant arts.

In operation, the lens system 300 can be configured to produce luminous intensities and pulse rates that comply with the UL 1971 standard. For example, the lens system 300 can be configured to control the LED light sources 120 to have a pulse rate of 20 milliseconds (ms), but is not limited thereto. The lens system 300 can be configured to generate luminous intensities similar to those illustrated in the plots 700 and 702 of FIGS. 7A and 7B, respectively. For example, the LED light sources 120 and corresponding lenses 100.1 to 100.5 can generate a luminous intensity of approximately 260 candela (cd) with a luminous flux of approximately 381 lumen (lm) (e.g., approximately 0.68 cd/lm), but is not limited to these values.

Figure 4B:
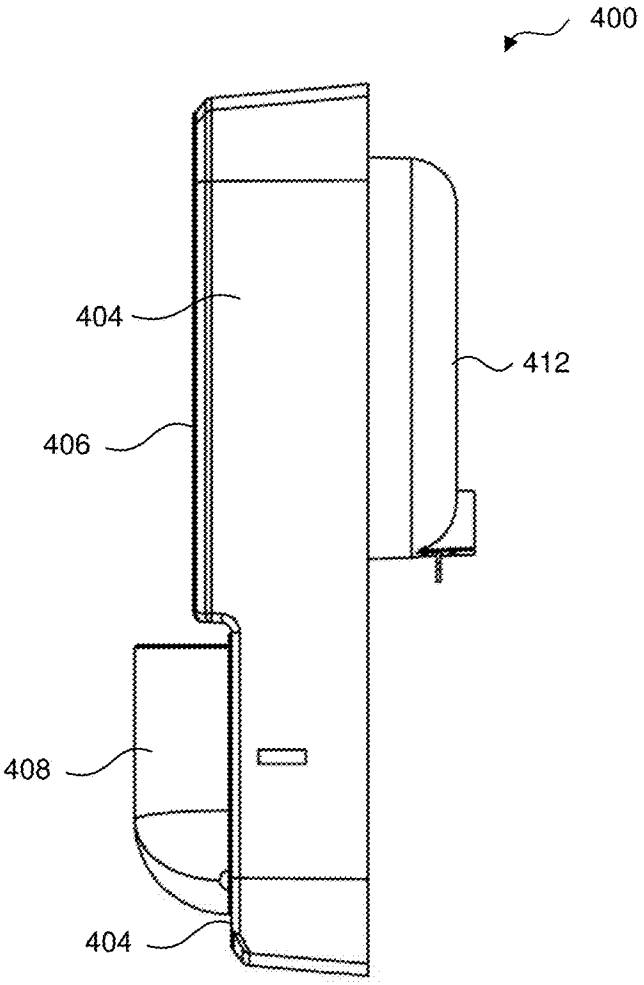
FIG. 4B illustrates a right side elevation view of the strobe light system of FIG. 4A.
Figure 4A:
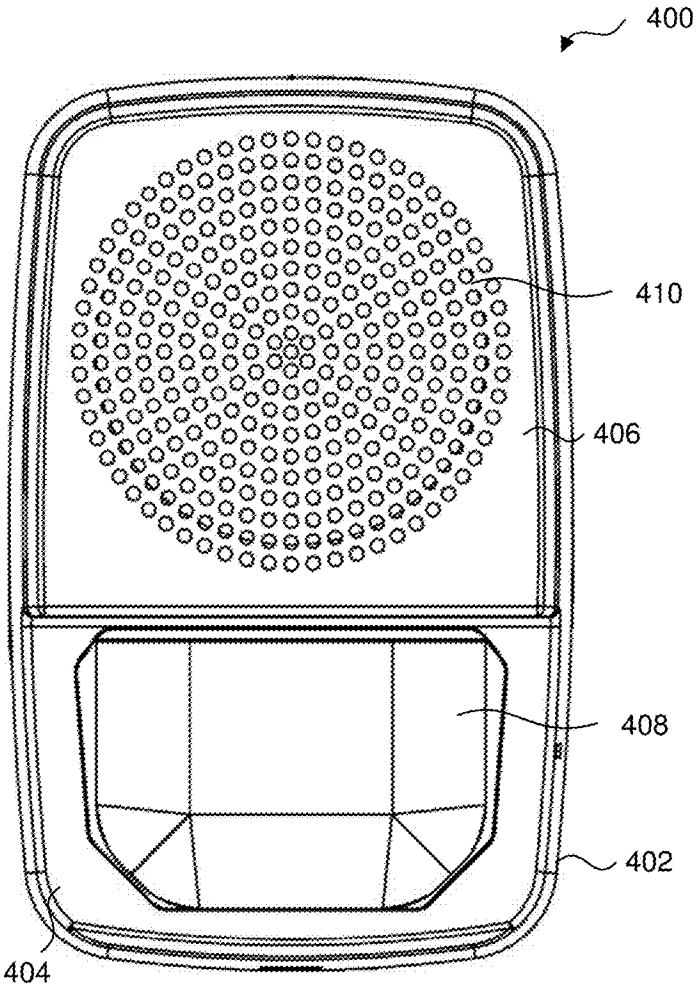
FIG. 4A illustrates a front elevation view of a strobe light system according to an exemplary embodiment of the present disclosure.
Figure 4D:
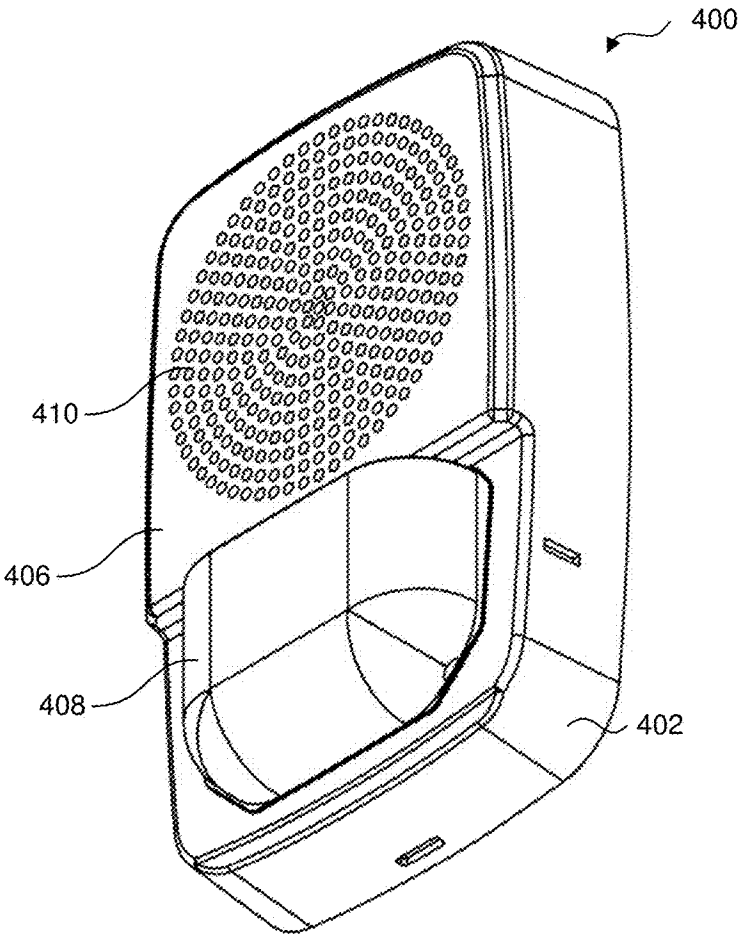
FIG. 4D illustrates a front right bottom prospective view of the strobe light system of FIG. 4A.

FIGS. 4A-4D illustrate a strobe light system 400 according to an exemplary embodiment of the present disclosure. The strobe light system 400 can include a base 402 having front surfaces 404 and 406. The strobe light system 400 can include a speaker 410, where the surface 406 can include one or more holes or grating to allow audio emitted from the speaker to exit the strobe light system 400. The speaker 410 can be configured to output one or more audio sounds such as an alarm signal and/or message. The strobe light system 400 can include a cover 408 disposed on the surface 404. The cover 408 can be disposed on one or more lenses and corresponding light sources (not shown). The cover 408 can be transparent or translucent and configured to protect the lenses and light sources contained therein. As shown in FIG. 4B, the strobe light system 400 can include a rear housing 412. The rear housing 412 can be configured to house one or more internal components of the strobe light system 400, including, for example, one or more controllers, circuits (e.g., drive circuitry, power supply circuitry, etc.), processors, and/or other components configured to control the operation of the strobe light system 400. In an exemplary embodiment, the controller can include one or more processors, circuits, and/or logic that are configured to control the operation of the one or light sources, including controlling the pulse rate and/or luminous intensity of the light sources.

Figure 4C:
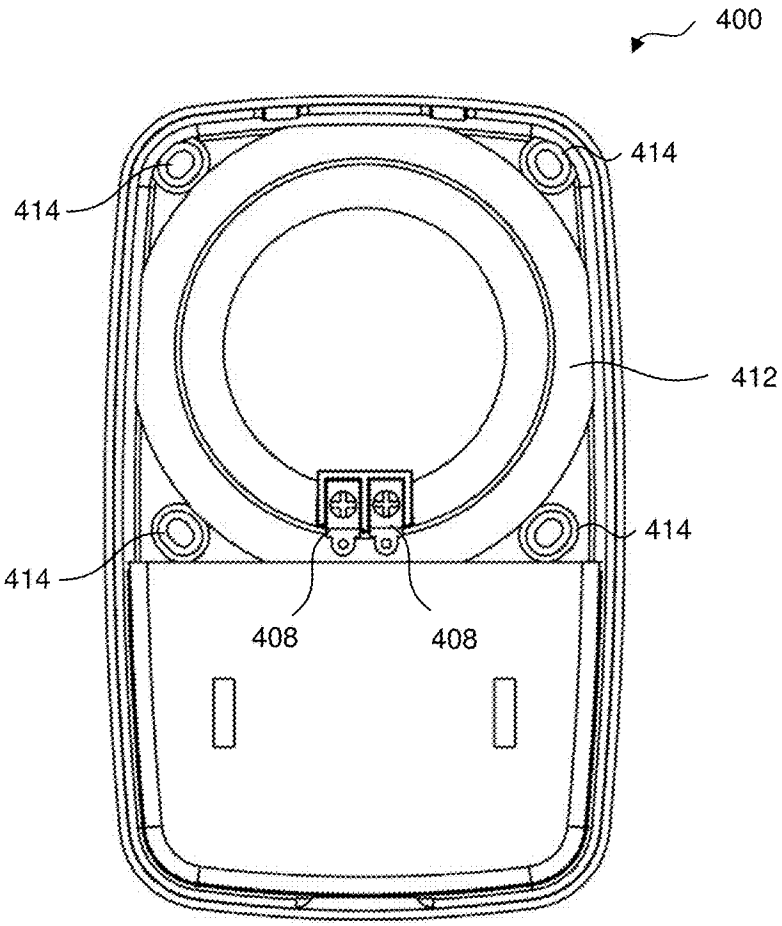
FIG. 4C illustrates a back elevation view of the strobe light system of FIG. 4A.

With reference to FIG. 4C, the back of the strobe light system 400 can include one or more mount points 414 configured to connect the strobe light system 400 to a surface (e.g., a wall, ceiling, etc.) so as to mount the strobe light system 400 on the surface. The mount points 414 can be, for example, ports to accept a fastener such as a screw. The strobe light system 400 can also include one or more terminals 416. The terminals 416 can be configured to electrically and/or communicatively connect the strobe light system 400 to one or more power sources and/or control sources. The terminals 416 can be configured to electrically and/or communicatively connect one or more components housed in the rear housing 412 to the power and/or control sources.

Figure 5B:
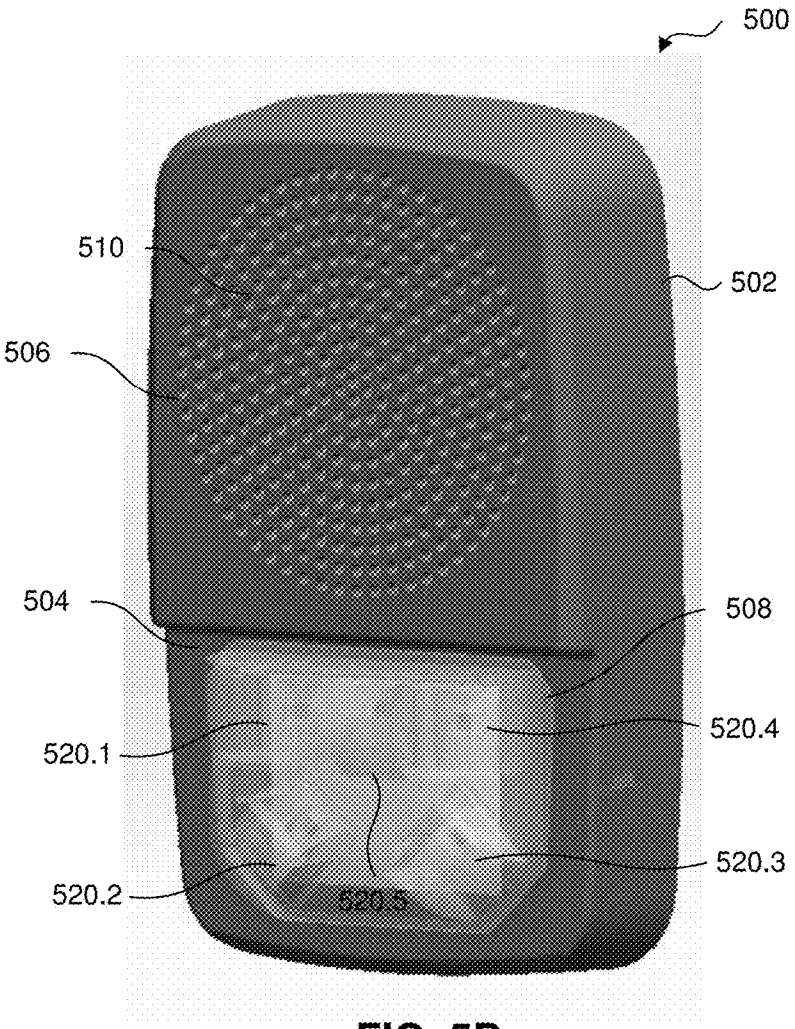
FIG. 5B illustrates a front right top prospective view of the strobe light system of FIG. 5A.
Figure 5A:
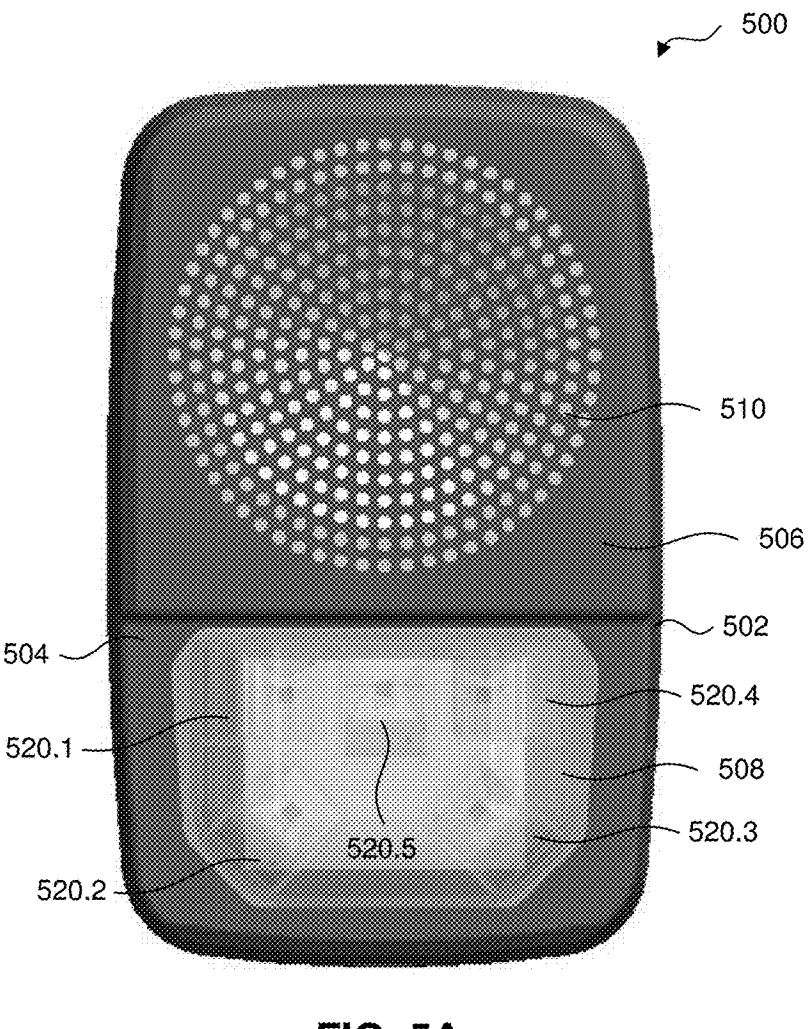
FIG. 5A illustrates a front elevation view of a strobe light system according to an exemplary embodiment of the present disclosure.

FIGS. 5A-5B illustrate a strobe light system 500 according to an exemplary embodiment of the present disclosure. The strobe light system 500 is similar to the strobe light system 400 and discussion of common elements may have been omitted for brevity. The strobe light system 500 can include a base 502 having front surfaces 504 and 506. The strobe light system 500 can include a speaker 510, where the surface 506 can include one or more holes or grating to allow audio emitted from the speaker to exit the strobe light system 500. The speaker 510 can be configured to output one or more audio sounds such as an alarm signal and/or message. The strobe light system 500 can include a cover 508 disposed on the surface 504. The cover 508 can be disposed on one or more lenses 520 and corresponding light sources. The lenses 520 can be exemplary embodiments of the lenses 120 illustrated in FIGS. 1A-1J.

In an exemplary embodiment, the strobe light system 500 can include five lenses 520.1 to 520.5 configured in an star arrangement similar to the embodiment illustrated in FIG. 2A. In another embodiment, the lenses 520.1 to 520.1 can be arranged in a semi-circular arrangement as illustrated in FIG. 3A. The strobe light system 500 is not limited to these exemplary lens arrangements and the strobe light system 500 can include one or more lenses 520 arranged in one or more configurations as would be understood by one of ordinary skill in the relevant arts.

Figure 6:
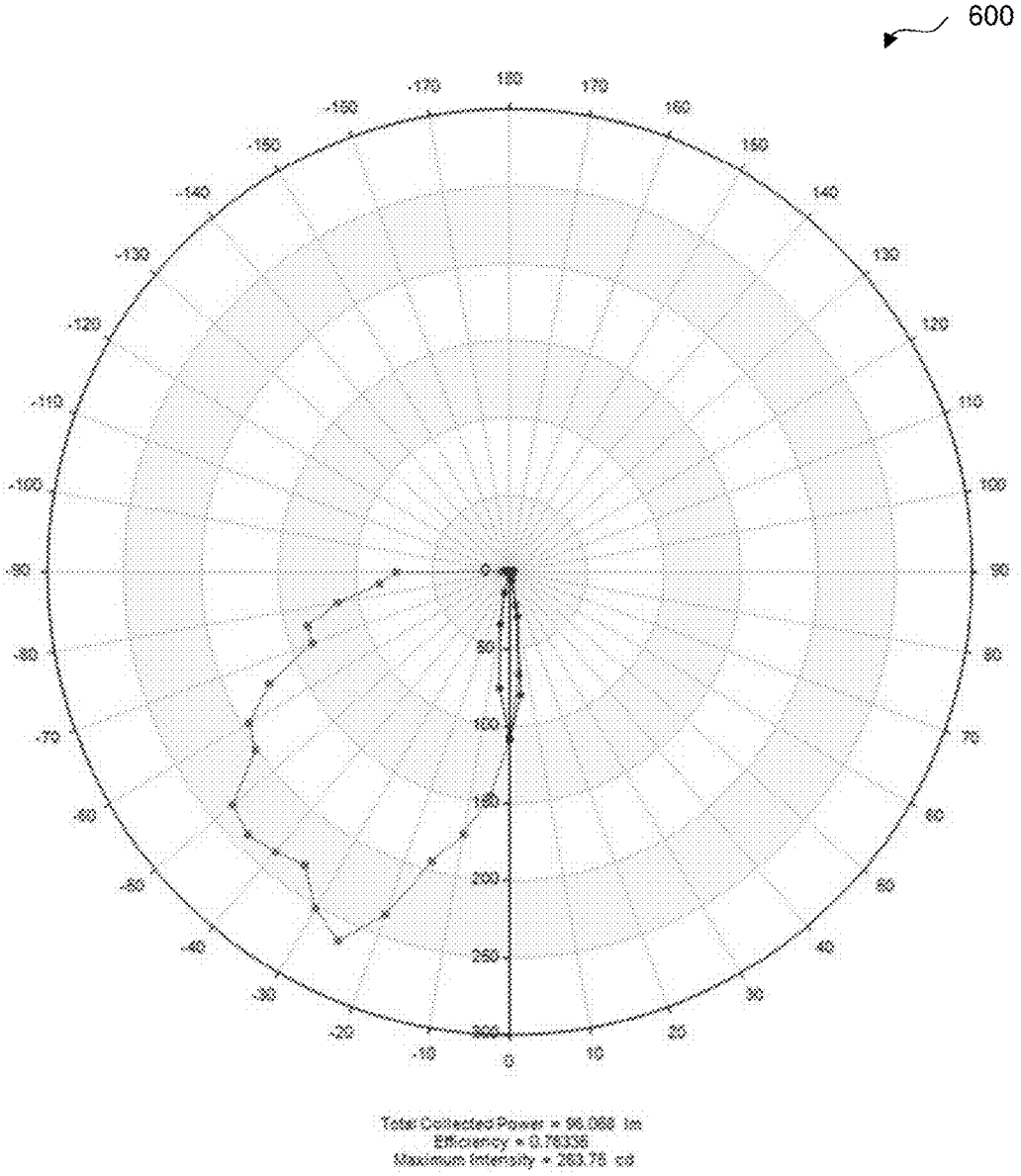
FIG. 6 illustrates a luminous intensity plot according to an exemplary embodiment of the present disclosure.

As discussed above, the exemplary lenses (e.g., lenses 100) and corresponding LED light sources can be configured to generate light having a pulse rate and luminous intensity that comply with the UL 1971 standard. For example, the lenses 100 and corresponding LED light sources can be configured to generate a light intensity far field angle distribution as illustrated in the luminous intensity plot 600 of FIG. 6. In this example, a lens 100 and corresponding LED light source 120 can generate a luminous intensity of approximately 263 candela (cd) with a luminous flux of approximately 96 lumen (lm).

Figure 7B:
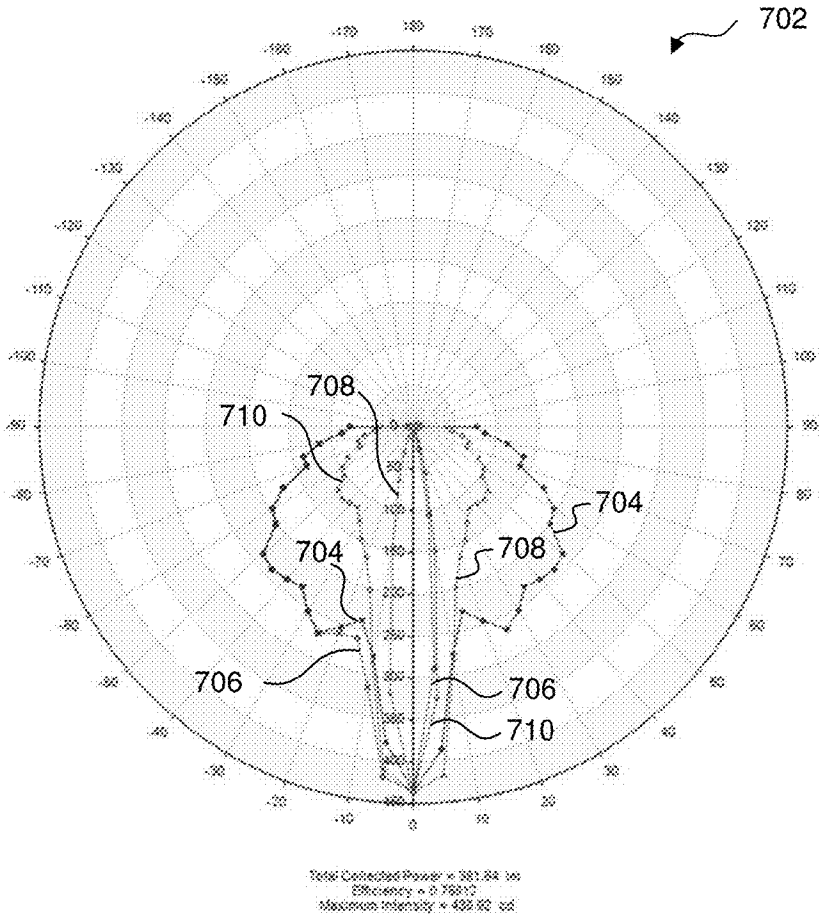
FIGS. 7A and 7B illustrate luminous intensity plots according to exemplary embodiments of the present disclosure.
Figure 7A:
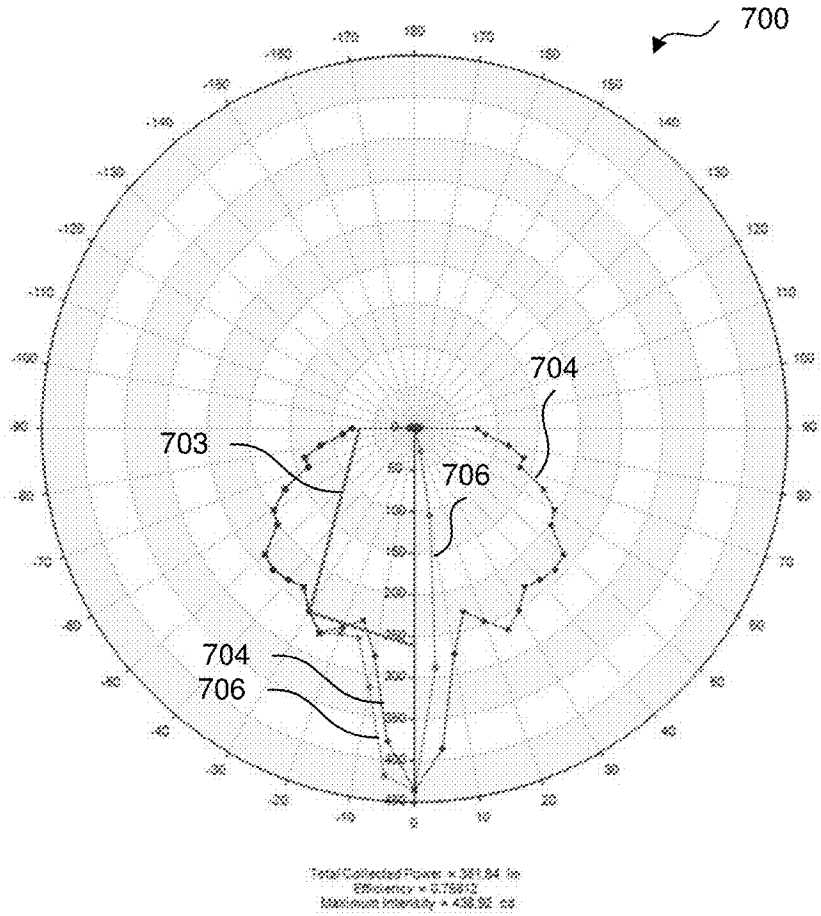

Similarly, as illustrated in FIGS. 7A and 7B, the strobe light systems 200, 400, and 500, and lens system 300 can be configured to generate light having a pulse rate and luminous intensity that comply with the UL 1971 standard. In exemplary embodiments, the strobe light systems 200, 400, and 500, and lens system 300 can be configured to generate light having a pulse rate of, for example, 20 milliseconds (ms), but are not limited thereto. In an exemplary embodiment, the strobe light systems 200, 400, and 500, and lens system 300 can be configured to generate a light intensity far field angle distribution as illustrated in the luminous intensity plots 700 and 702 of FIGS. 7A and 7B, respectively. For example, the strobe light systems 200, 400, and 500, and lens system 300 can generate a luminous intensity of, for example, approximately 260 candela (cd) with a luminous flux of, for example, approximately 381 lumen (lm) (e.g., approximately 0.68 cd/lm), but are not limited to these values.

With reference to FIG. 7A, the luminous intensity required to meet the UL 1971 standard is shown as plot line 703. Plot lines 704 correspond to luminous intensities of the horizontally arranged lenses 100 (e.g., 100.1 and 100.4). Plot lines 706 correspond to the luminous intensities of the vertically arranged lens 100 (e.g., 100.5). Similarly, FIG. 7B illustrates the luminous intensities of the horizontally and vertically arranged lenses as plots lines 704 and 706, respectively. The luminous intensity plot 702 of FIG. 7B further illustrates the luminous intensities of the lenses arranged between the horizontally and vertically arranged lenses. For example, plot lines 708 and 710 correspond to the luminous intensities produced by lenses 100.2 and 100.4, respectively.

Figure 8A:
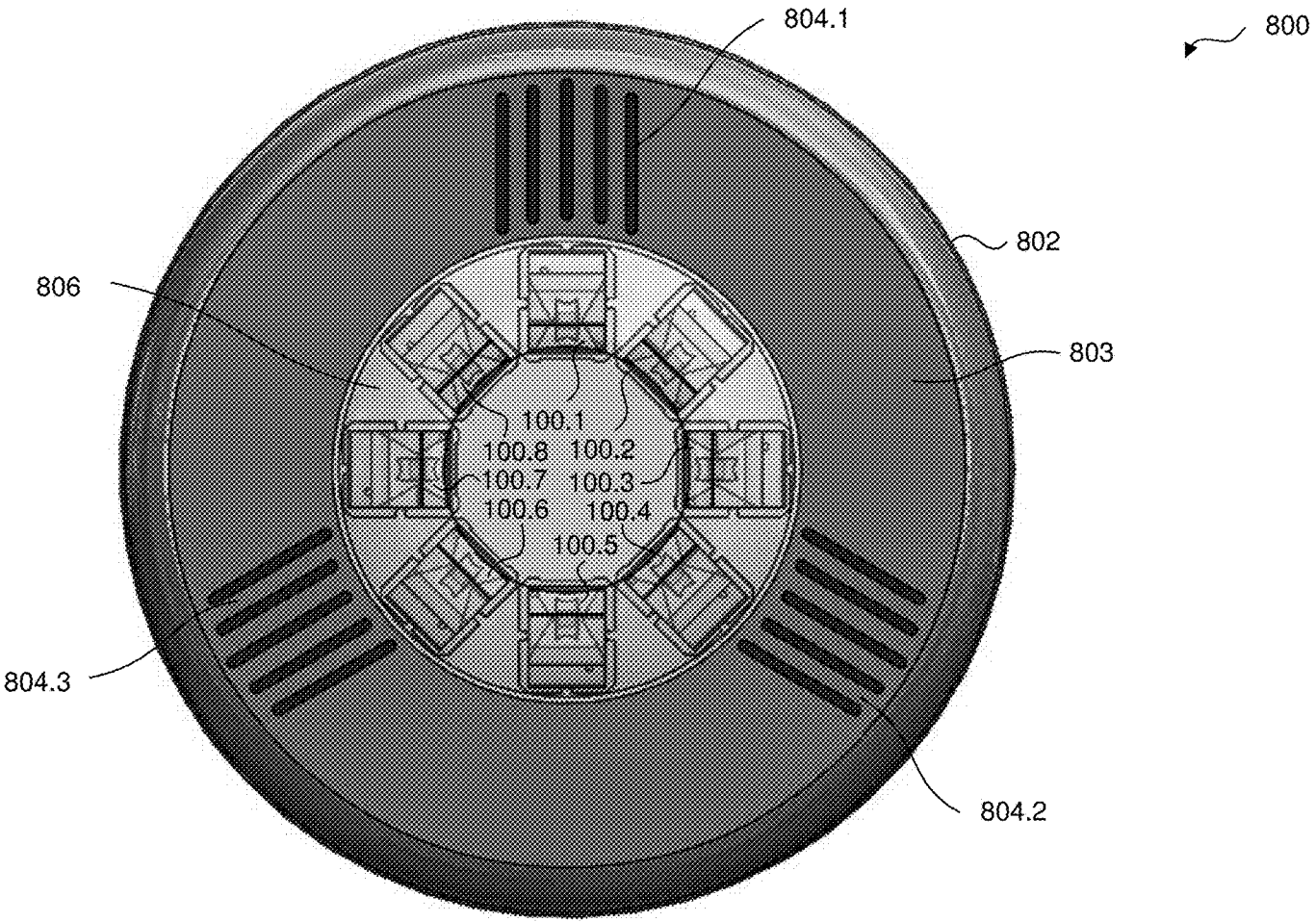
FIG. 8A illustrates a bottom elevation view of a strobe light system according to an exemplary embodiment of the present disclosure.

FIGS. 8A-2F illustrate a strobe light system 800 according to an exemplary embodiment of the present disclosure. The strobe light system 800 can include one or more light sources and corresponding lenses. For example, the strobe light system 800 can include one or more lenses 100.

Figure 8B:
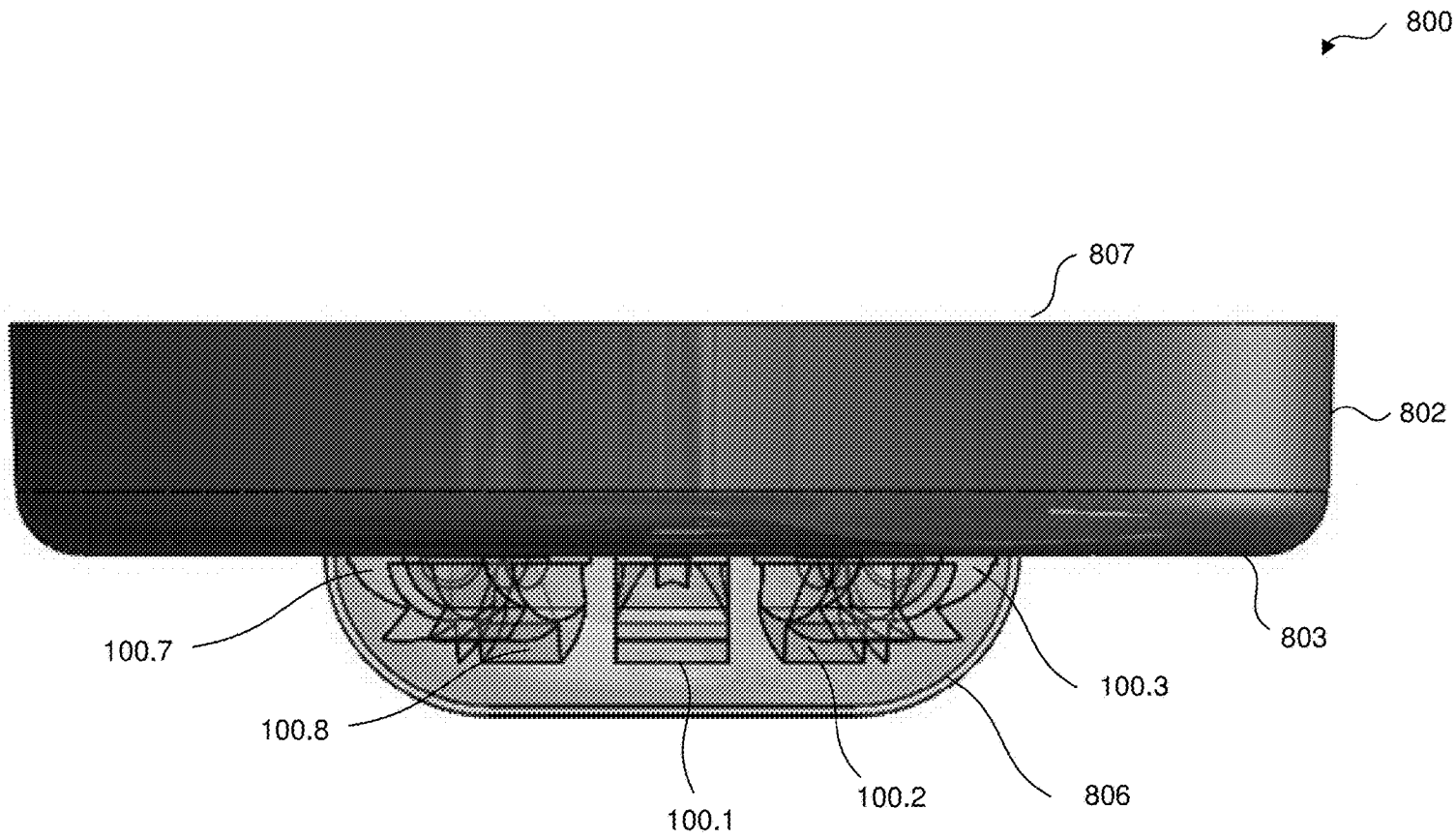
FIG. 8B illustrates a side elevation view of the strobe light system of FIG. 8A.
Figure 8C:
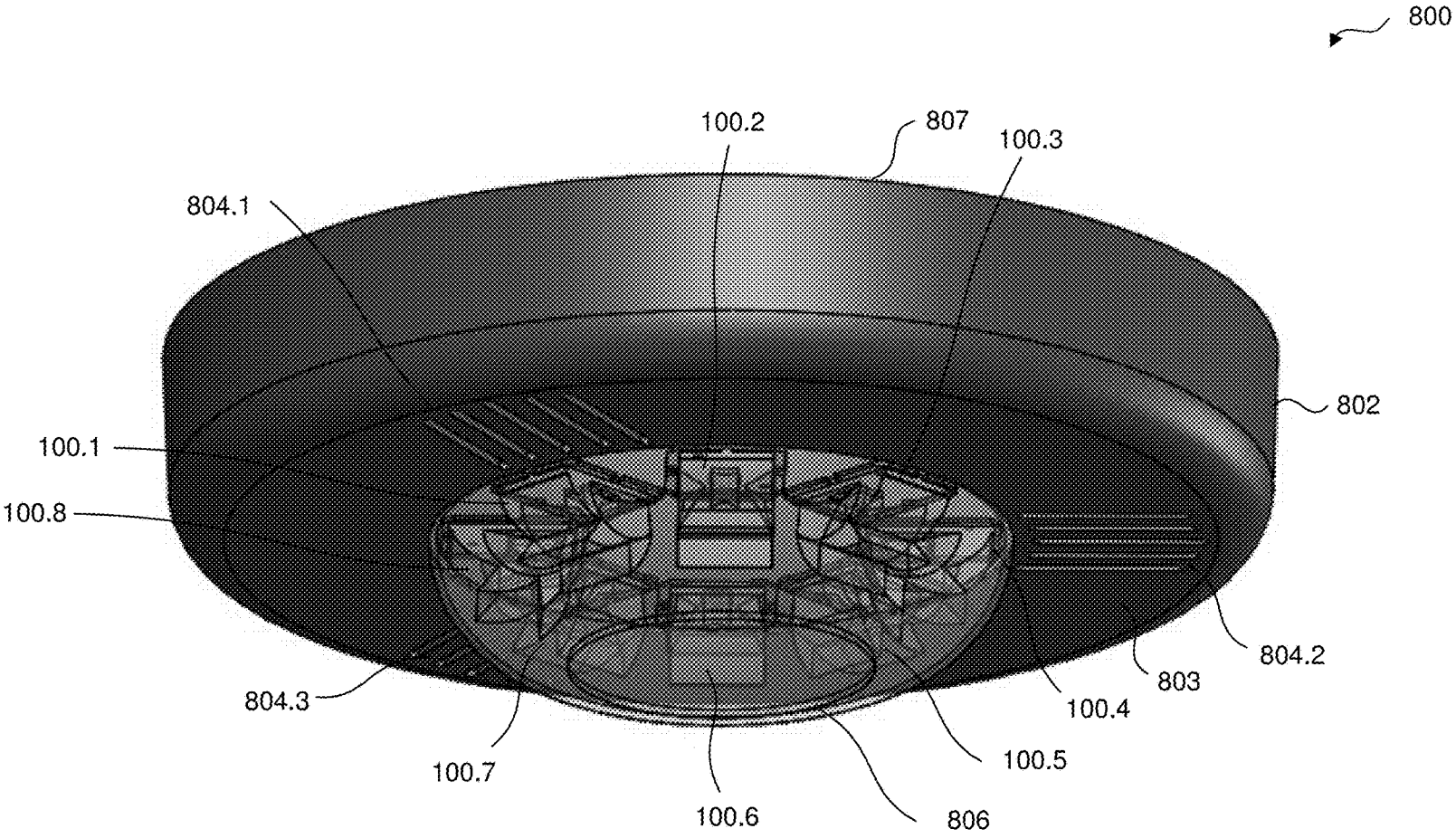
FIG. 8C illustrates a bottom side prospective view of the strobe light system of FIG. 8A.
Figure 8E:
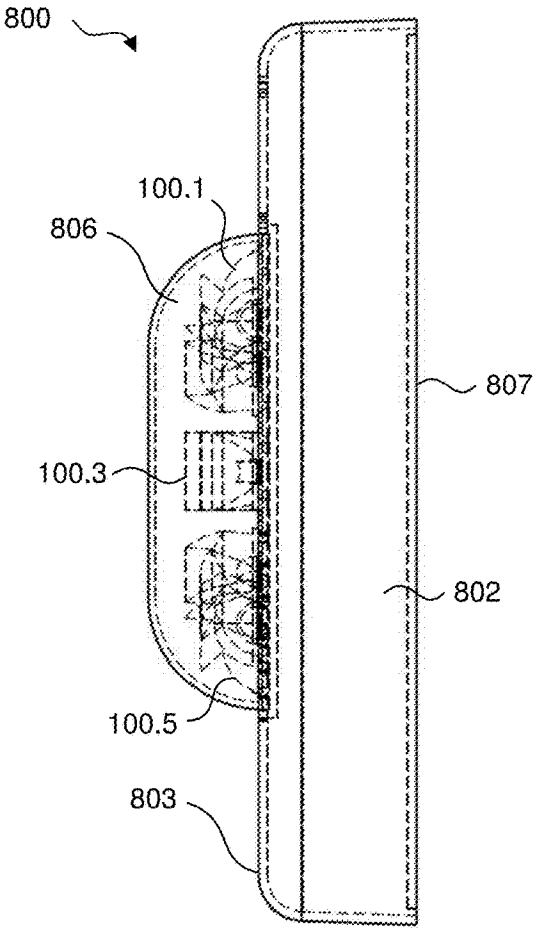
FIG. 8E illustrates a schematic side elevation view of a strobe light system of FIG. 8A.
Figure 8D:
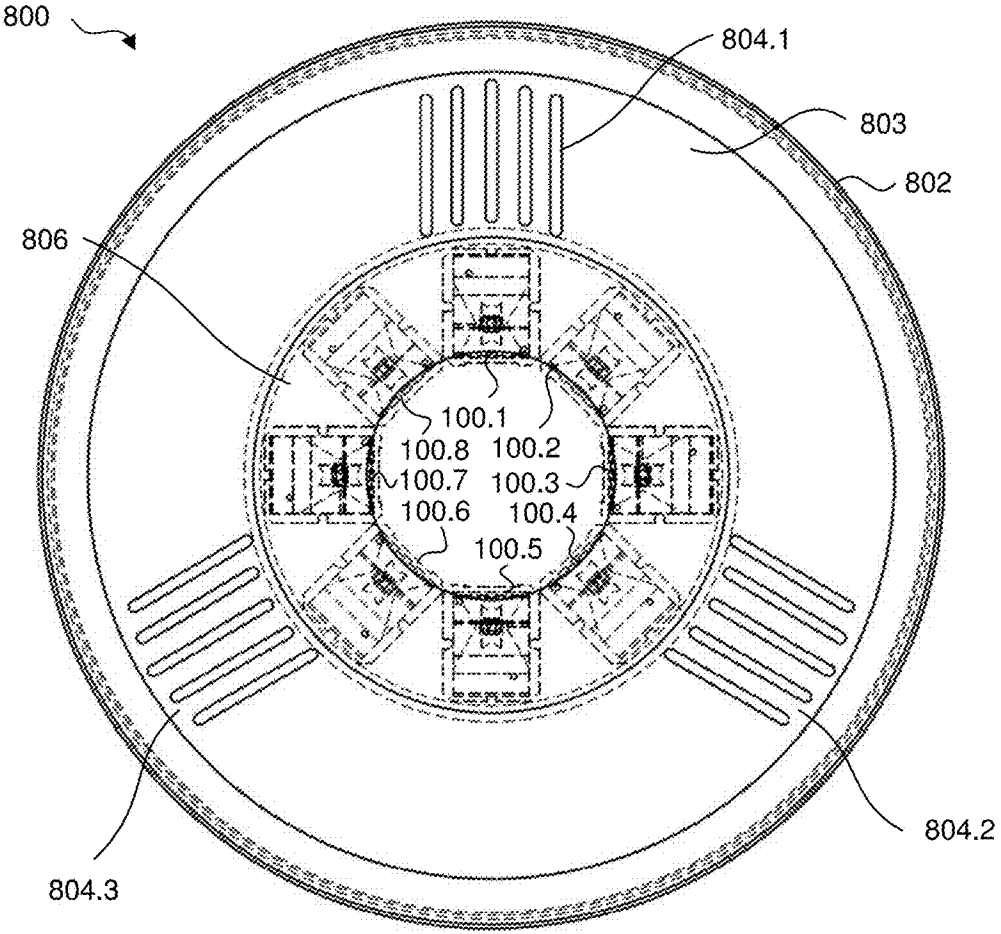
FIG. 8D illustrates a schematic bottom elevation view of a strobe light system of FIG. 8A.
Figure 8F:
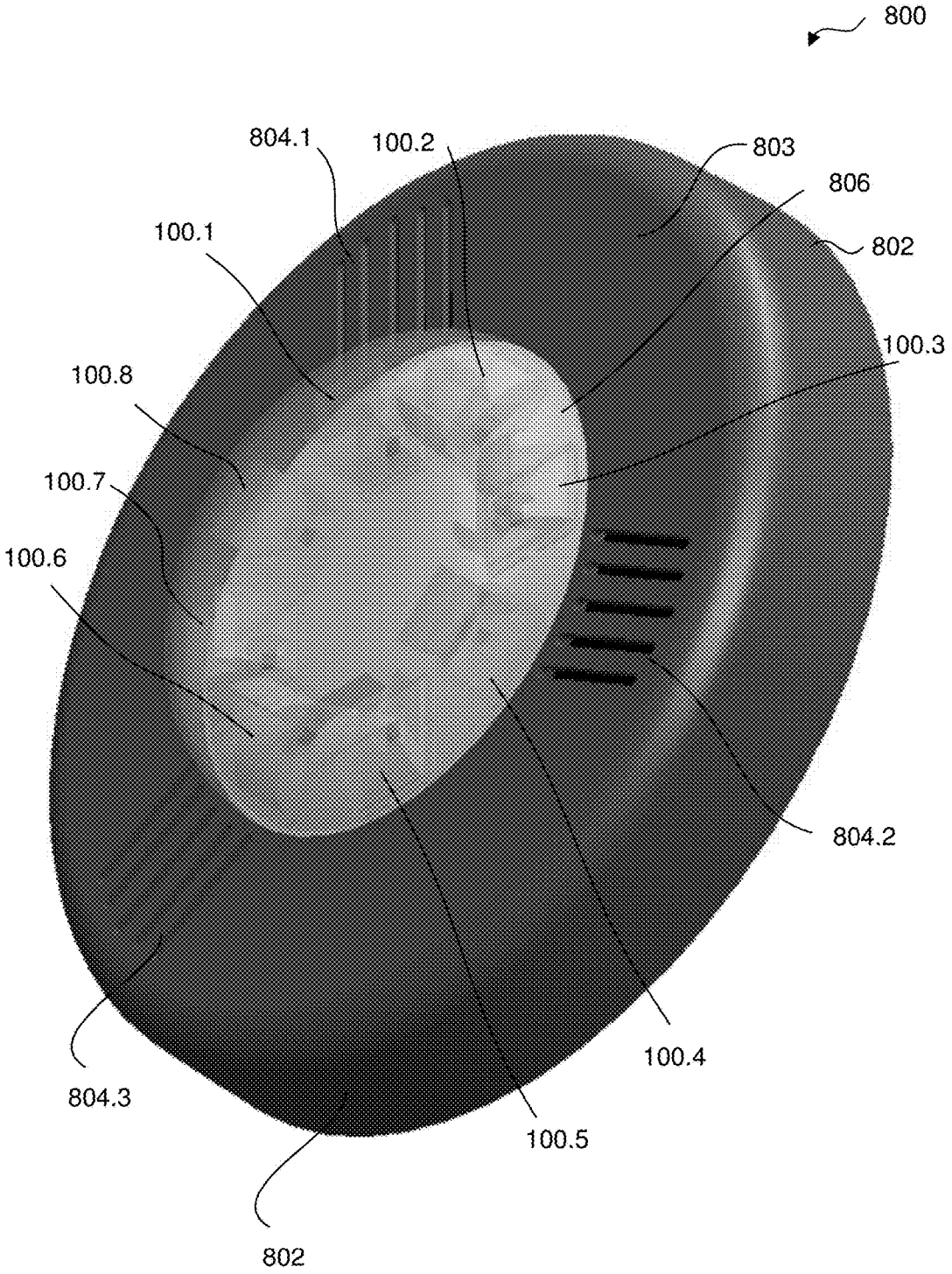
FIG. 8F illustrates a bottom side prospective view of the strobe light system of FIG. 8A.

FIG. 8A illustrates a bottom elevation view of the strobe light system 800. The strobe light system 800 can include a base having a side surface 802, a bottom surface 803, and a top surface 807 (see FIG. 8B). One or more lenses, such as lenses 100 can be formed on bottom surface 803. The strobe light system 800 can include a cover 806 that is disposed on the bottom surface 803 and over the lenses 100. The cover 806 can be, for example, transparent or translucent and configured to protect the lenses 100. One or more speakers 804 can be formed on the bottom surface 803. The speakers 804 can be configured to output audible sound such as an alarm signal and/or message.

In an exemplary embodiment, the strobe light system 800 includes lenses 100.1 to 100.8 configured in a circular arrangement. For example, as illustrated in FIGS. 8A, 8C, 8D, and 8F, lenses 100.1 to 100.8 can be arranged at 90, 45, 0, 315, 270, 225, 180, and 135 degrees, respectively. In this configuration, the strobe light system 800 can provide 360 degree visual indications. The number of lenses 100 and the angular configurations are not limited to these examples, and the number of lenses 100 and respective angular arrangements can be modified as would be understood by those skilled in the relevant arts.

The strobe light system 800 can be mounted to a surface (e.g., a ceiling, floor, etc). For example, with reference to FIG. 8B, the top surface 807 can be mounted to a ceiling.

In an exemplary embodiment, the strobe light system 800 can be configured to control the LED light sources 120 of corresponding lenses 100.1 to 100.8 to operate with pulse rates and luminous intensities that comply with the UL 1971 standard. For example, the strobe light system 800 can be configured to control the LED light sources 120 to have a pulse rate of 20 milliseconds (ms), but is not limited thereto. In an exemplary embodiment, the strobe light system 800 can be configured to control the LED light source 120 and corresponding lens 100 to generate a luminous intensity as illustrated in the plot 600 of FIG. 6.

FIGS. 9A-9J illustrate a lens 900 according to an exemplary embodiment of the present disclosure. The lens 900 can include a base 902 that supports one or more lens elements. For example, the lens 900 can include four lens elements 904, but is not limited thereto. Each of the lens elements 904 can include one or more lens segments 906. In an exemplary embodiment, the lens element 904 includes two lens segments 906 that collectively form the lens element 904. The lens element 904 can be, for example, round, bulbous, convex, or other shaped configurations as would be understood by one of or ordinary skill in the art. In an exemplary embodiment, the lens 900 is a multi-lens system where each of the lens elements 904 is configured as a lens of the multi-lens 900. A rib or valley 910 is formed between adjacent lens elements 904. The rib or valley 910 is a center of a concave portion formed by two adjacent lens segments 906.

In an exemplary embodiment, the lens element 904 is a convex structure, where the multiple lens elements 904 collectively form, for example, an overall dome-shaped, cupola-shaped, or hemispherical lens 900. The lens elements can be petal-shaped, triangularly-shaped, or other shaped configurations as would be understood by one of or ordinary skill in the art.

The lens elements 904 are arranged around the base 902 and extend from the base 902 to meet together at a crown 903 of the lens 900. The overall dome/cupola/hemispherical shape of the lens 900 can be similar to, for example, an umbrella-dome structure, a melon-dome structure, or other rounded, dome, cupola, hemispherical, bulbous, or other shaped configurations as would be understood by one of or ordinary skill in the art.

Further, the lens element(s) 904 can include a sloped portion 908 and a recessed portion 909 at the end of the lens element 904 that contacts the base 902 of the lens 900. The sloped portions 908 and the recessed portions 909 of the lens 900 can collectively form a drum of the dome-shaped lens 900. As illustrated in FIG. 9A, two adjacent recessed portions 909 of adjacent lens segments 904 form a concave or recessed portion 925 of the lens 900.

In an exemplary embodiment, lens elements 904 can be Fresnel lens elements/segments similar to those of a Fresnel lens.

The lens 900 can be formed of one or more transparent or translucent materials. In an exemplary embodiment, the lens 900 is formed of polycarbonate, but is not limited thereto and the lens 900 can be formed of other materials as would be understood by one of ordinary skill in the art.

Figure 9B:
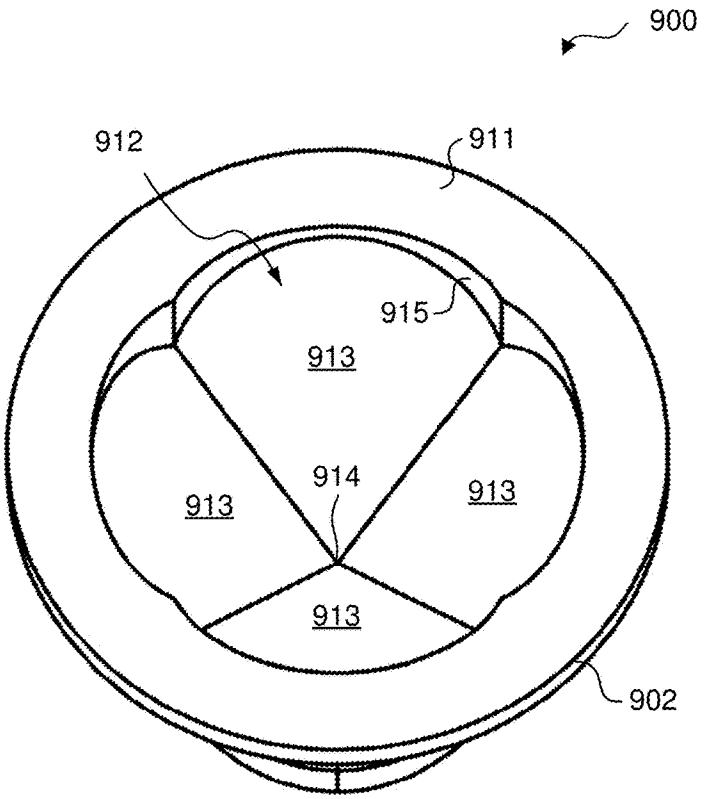
FIG. 9B illustrates a bottom prospective view of the lens of FIG. 9A.
Figure 9A:
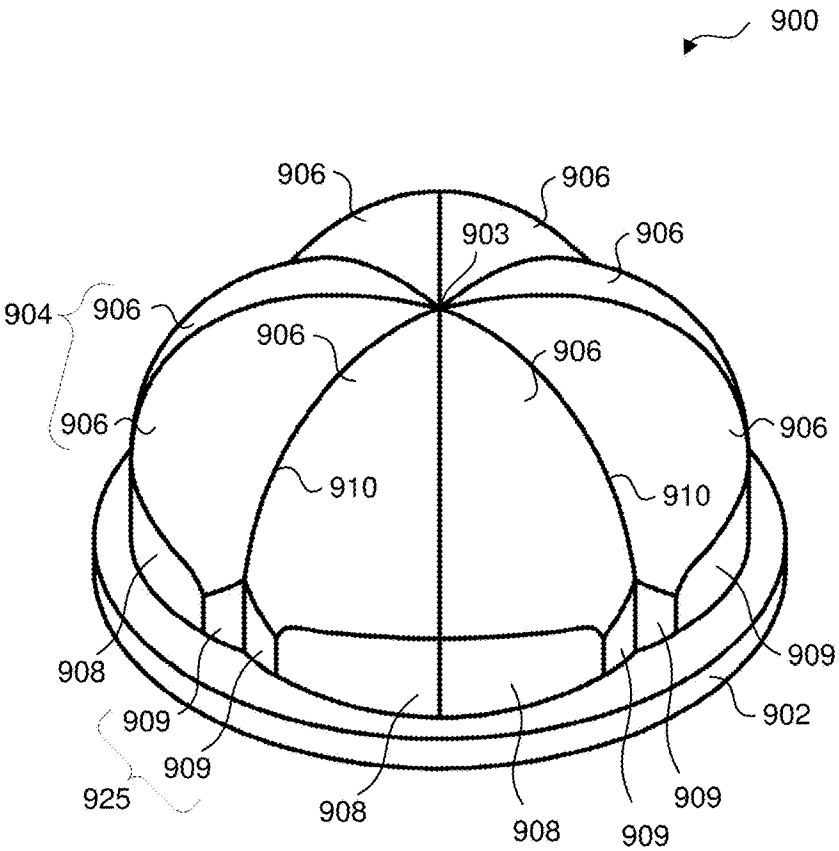
FIG. 9A illustrates a top prospective view of a lens according to an exemplary embodiment of the present disclosure.
Figure 9C:
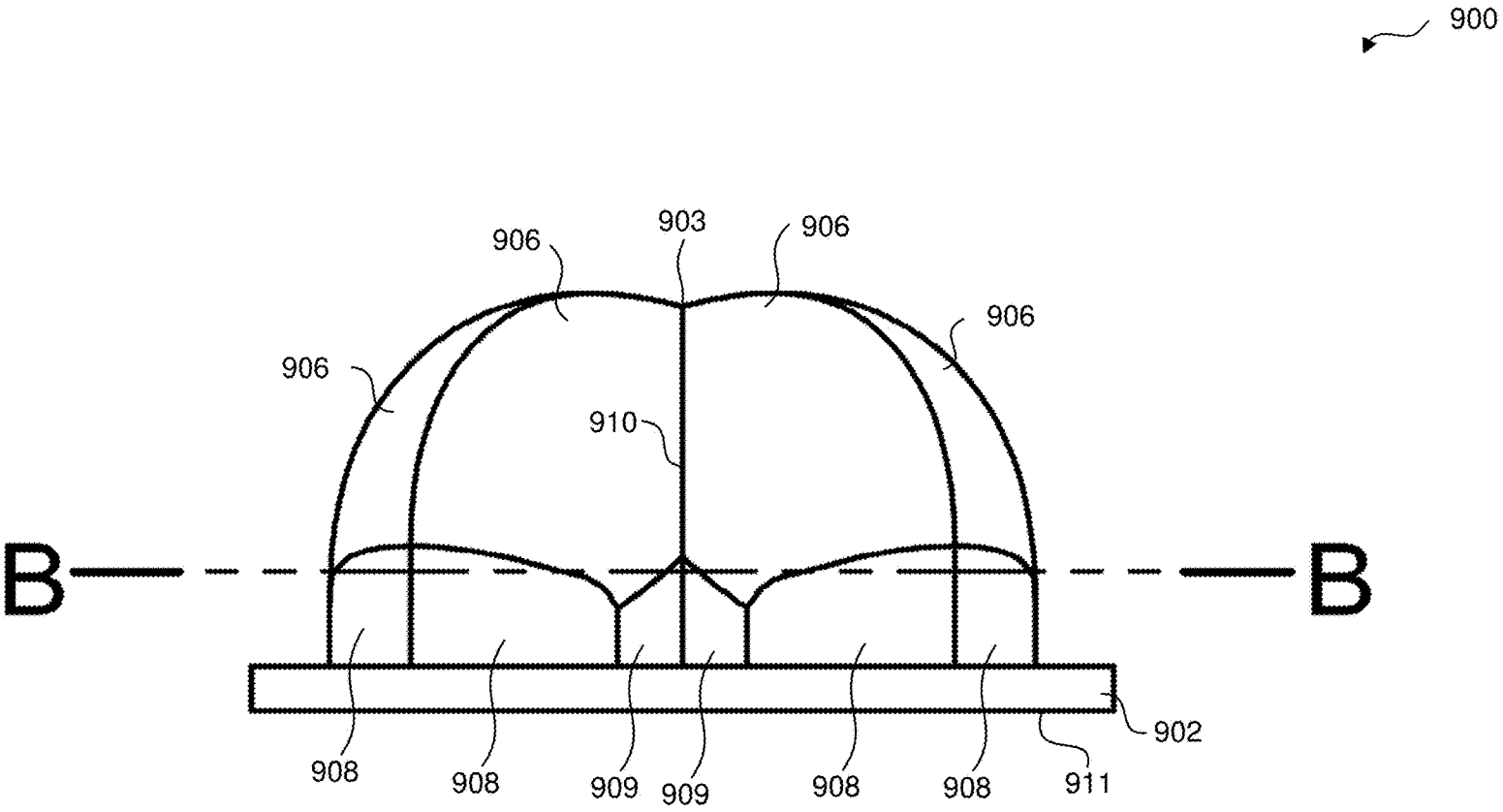
FIG. 9C illustrates a side elevation view of the lens of FIG. 9A.
Figure 9D:
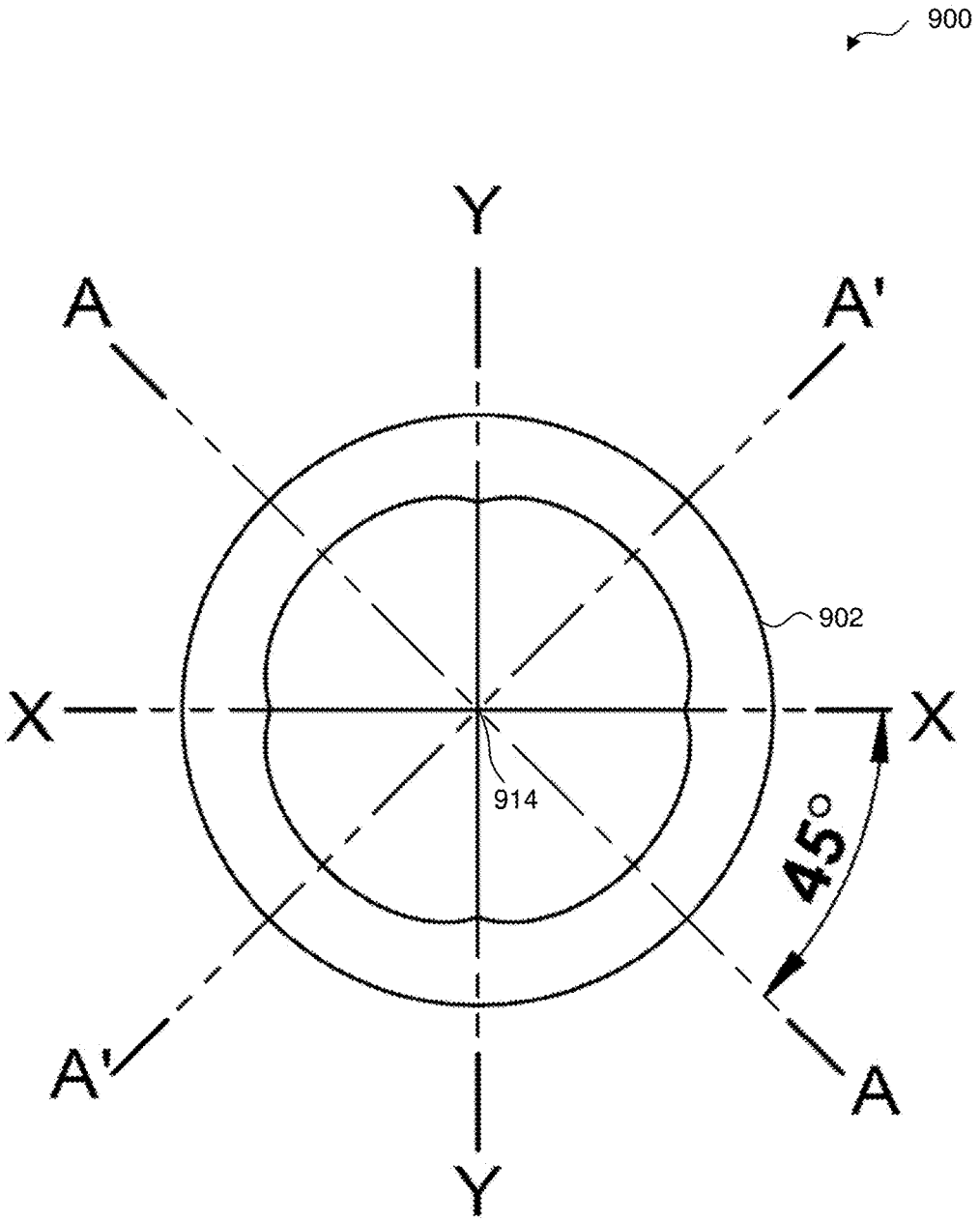
FIG. 9D illustrates a bottom view of the lens of FIG. 9A.

With reference to FIG. 9B, the bottom 911 of the lens 900 can include an opening to a cavity 912. The cavity 912 can be configured to receive and house one or more light sources, such as LED light source 920 as illustrated in FIGS. 9E-9H and 9J. The LED light source 920 can include one or more LEDs that are configured to emit one or more colors. For example, the LED light source 920 can include one or more white LEDs. The LED light source 920 can include a plurality of LEDs such as red, green and/or blue ("RGB") LEDs whose output can be controlled such that the RGB components mix according to known principles to create any visible color (including black and white). The light source 920 can be similar to the light source 120. In an exemplary embodiment, the LED light source 920 can be model "LED2245 PC" produced by Bayer MaterialScience (also known as Bayer Covestro), but is not limited thereto. In another exemplary embodiment, the LED light source 920 can be a Cree's High-Density Discrete LED model "XLamp XB-H."

In an exemplary embodiment, the LED light source 920 and corresponding lens 900 can be configured to emit pulsed light at a pulse rate and luminous intensity that comply with the UL 1971 standard. For example, the lighting system (e.g., light source 920 and lens 900) can generate a luminous intensity of approximately 260 candela (cd) with a luminous flux of approximately 96 lumen (lm) (e.g., approximately 2.7 cd/lm), but is not limited to these values. In an exemplary embodiment, the lighting system can be configured to generate light with a pulse rate of, for example, 20 milliseconds (ms), but is not limited thereto.

With continued reference to FIG. 9B, in an exemplary embodiment, the cavity 912 can be formed faces 913 that extend from cavity walls 915 to an apex 914. The faces 913 can be petal-shaped, triangularly-shaped, or other shaped configurations as would be understood by one of or ordinary skill in the art. In an exemplary embodiment, the faces 913 are planar, but are not limited thereto. The cavity 912 can have, for example, an overall pyramid shape with the faces 913 forming sides of the pyramid shape, but is not limited thereto. In an exemplary embodiment, the faces 913 form a forty-five (45) degree angle with respect to the bottom 911 of the lens 900, but is not limited thereto and can be configured at other angular values as would be understood by one of ordinary skill in the relevant arts.

Figure 9F:
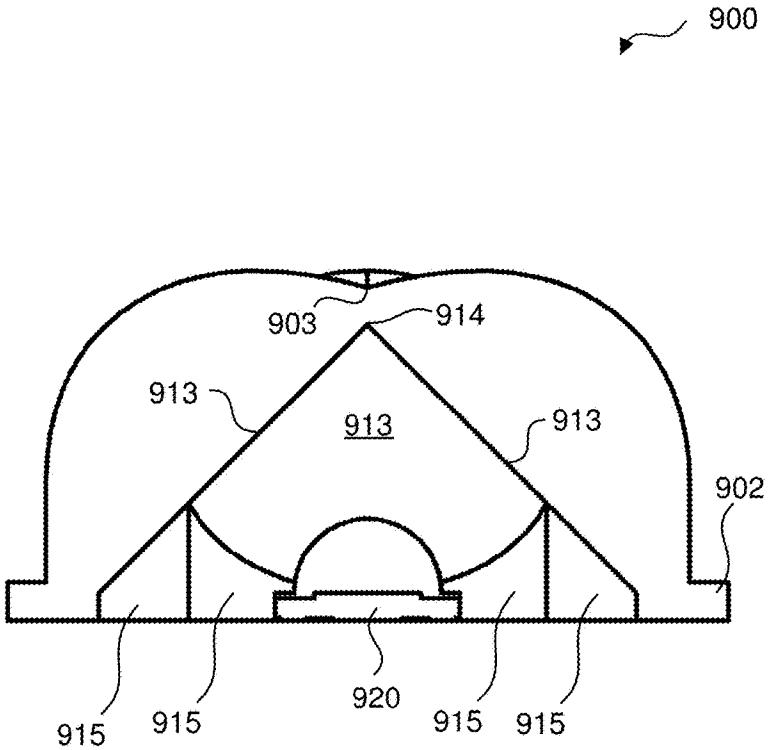
FIG. 9F illustrates a cross-sectional view taken along A-A or A'-A' in FIG. 9D.
Figure 9E:
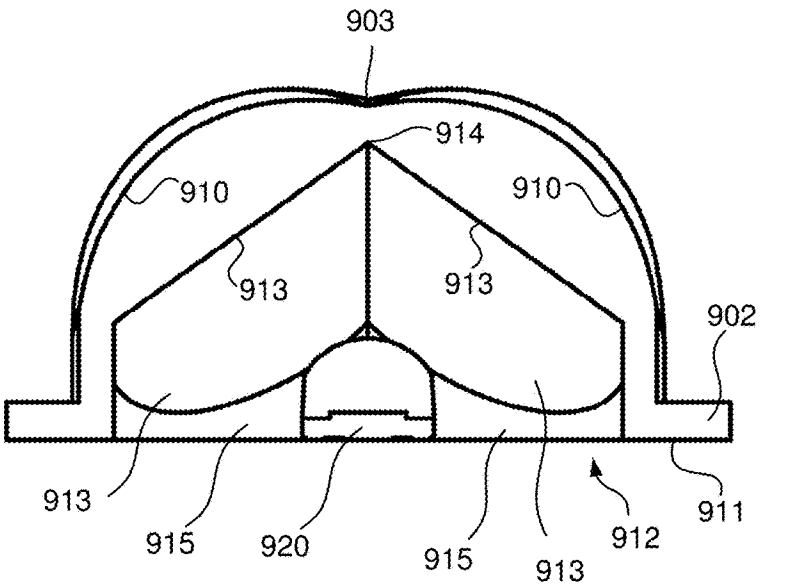
FIG. 9E illustrates a cross-sectional view taken along X-X or Y-Y in FIG. 9D.
Figure 9H:
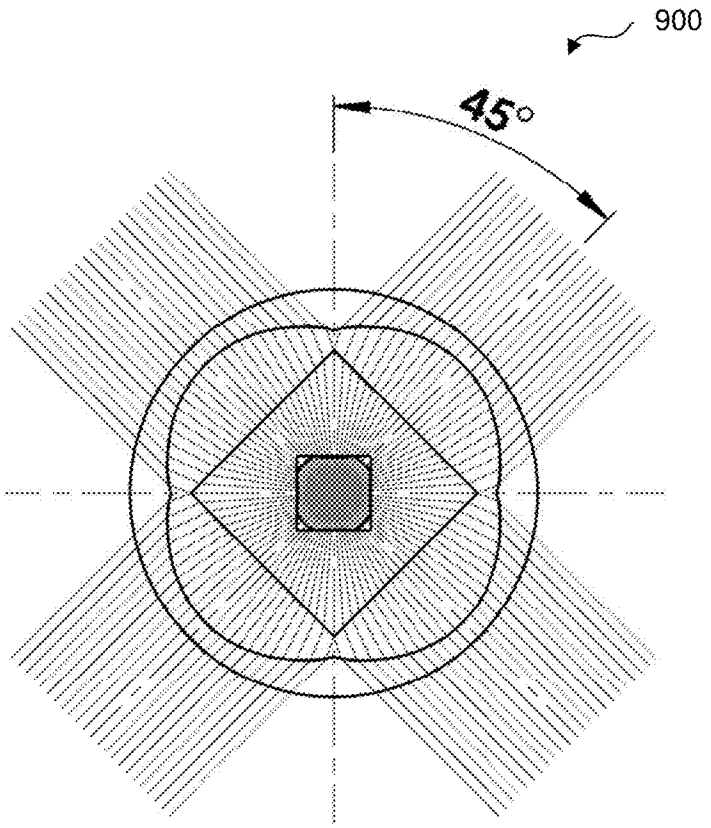
FIG. 9H illustrates a cross-sectional view taken along B-B in FIG. 9C.
Figure 9G:
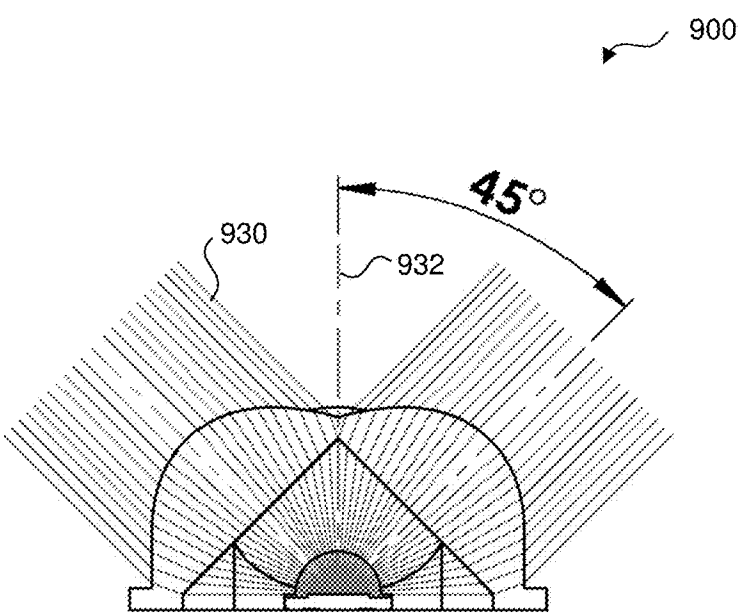
FIG. 9G illustrates a cross-sectional view taken along A-A or A'-A' in FIG. 9D and shows light rays.
Figure 9J:
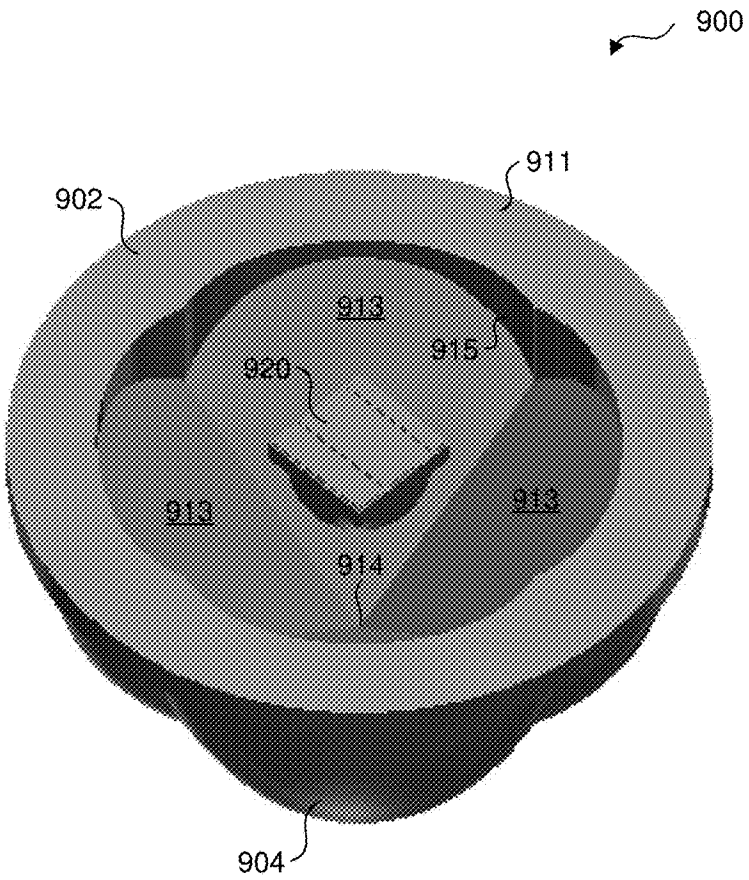
FIG. 9J illustrates a bottom prospective view of the lens of FIG. 9A and includes a light source.
Figure 9I:
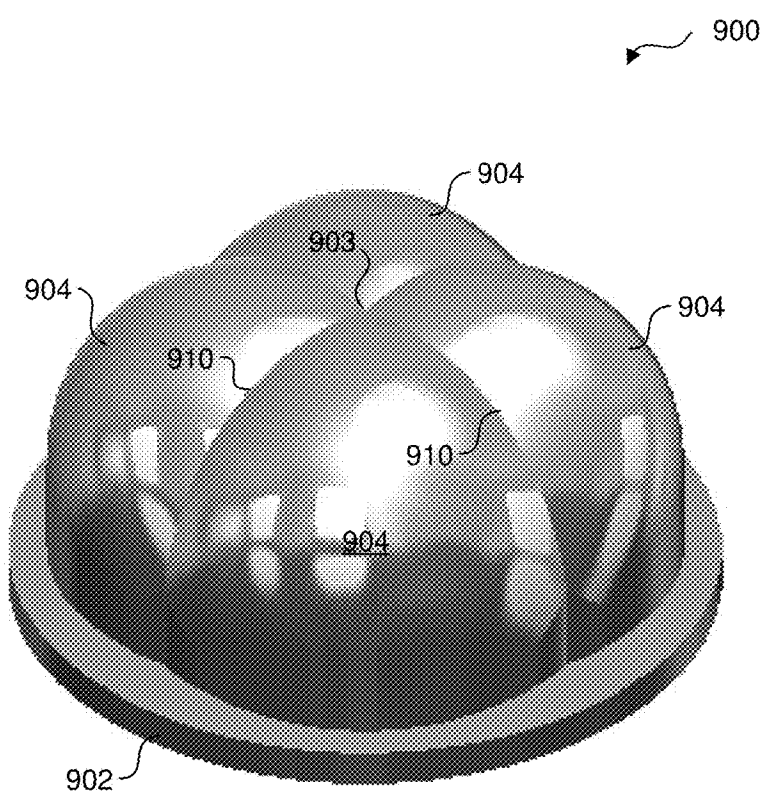
FIG. 9I illustrates a top prospective view of the lens FIG. 9A.

In operation, and with reference to FIGS. 9G-H, light generated by one or more light sources 920 can exit the cavity 912 through the faces 913 and enter the lens elements 904. The light can then exit the lens elements 904 through the exterior surfaces of the lens elements 904.

FIGS. 9G and 9H illustrate the light rays 930 that are emitted from the LED light source 920 and pass through and exit the lens elements 904. FIG. 9G is a cross-sectional view of the lens 900 taken along line A-A or A'-A' as shown in the bottom view of the lens 900 shown in FIG. 9D. FIG. 9H is a cross-sectional view of the lens 900 taken along line B-B as shown in the side view of the lens 900 shown in FIG. 9C.

FIGS. 9E and 9F illustrate cross-sectional views of the lens 900. FIG. 9E illustrates a cross-sectional view of the lens 900 taken along line X-X or Y-Y as shown in the bottom view of the lens 900 shown in FIG. 9D. FIG. 9F illustrates a cross-sectional view of the lens 900 taken along line A-A or A'-A' as shown in the bottom view of the lens 900 shown in FIG. 9D.

The light rays 930 can exit the lens elements at, for example, a forty-five (45) degree angle with respect to the optical axis 932. The angular configuration is not limited to this exemplary value and the angle at which the light rays 930 exit the lens elements 904 can be other angular values as would be understood by one of ordinary skill in the relevant arts.

Figure 10B:
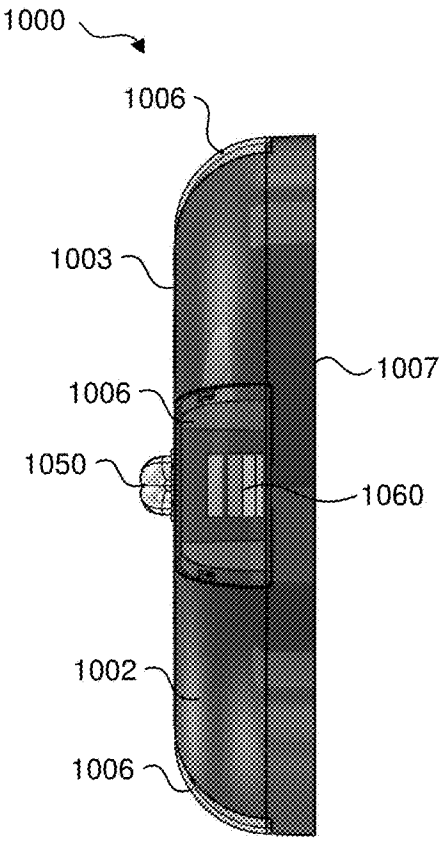
FIG. 10B illustrates a side elevation view of the strobe light system of FIG. 10A.
Figure 10A:
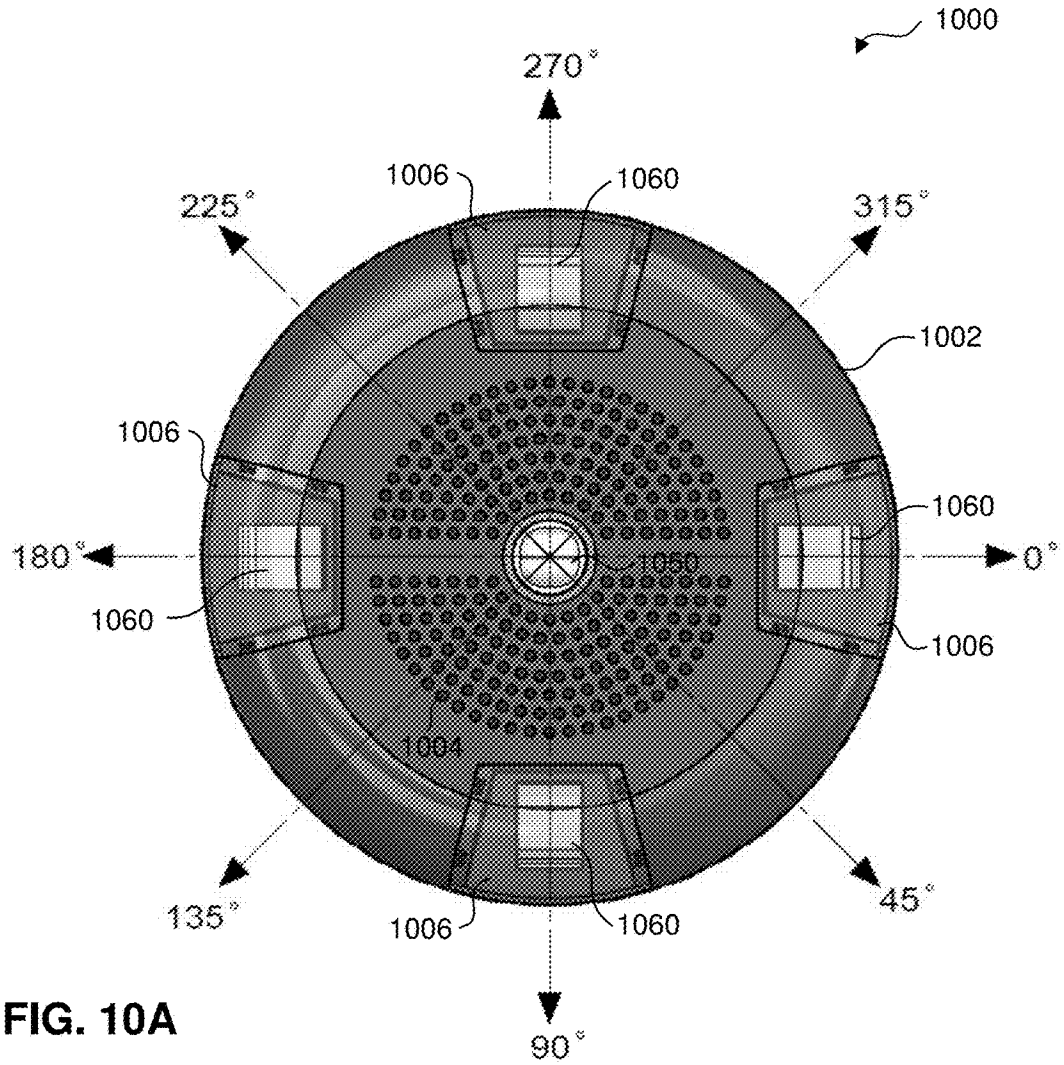
FIG. 10A illustrates a bottom elevation view of a strobe light system according to an exemplary embodiment of the present disclosure.
Figure 10C:
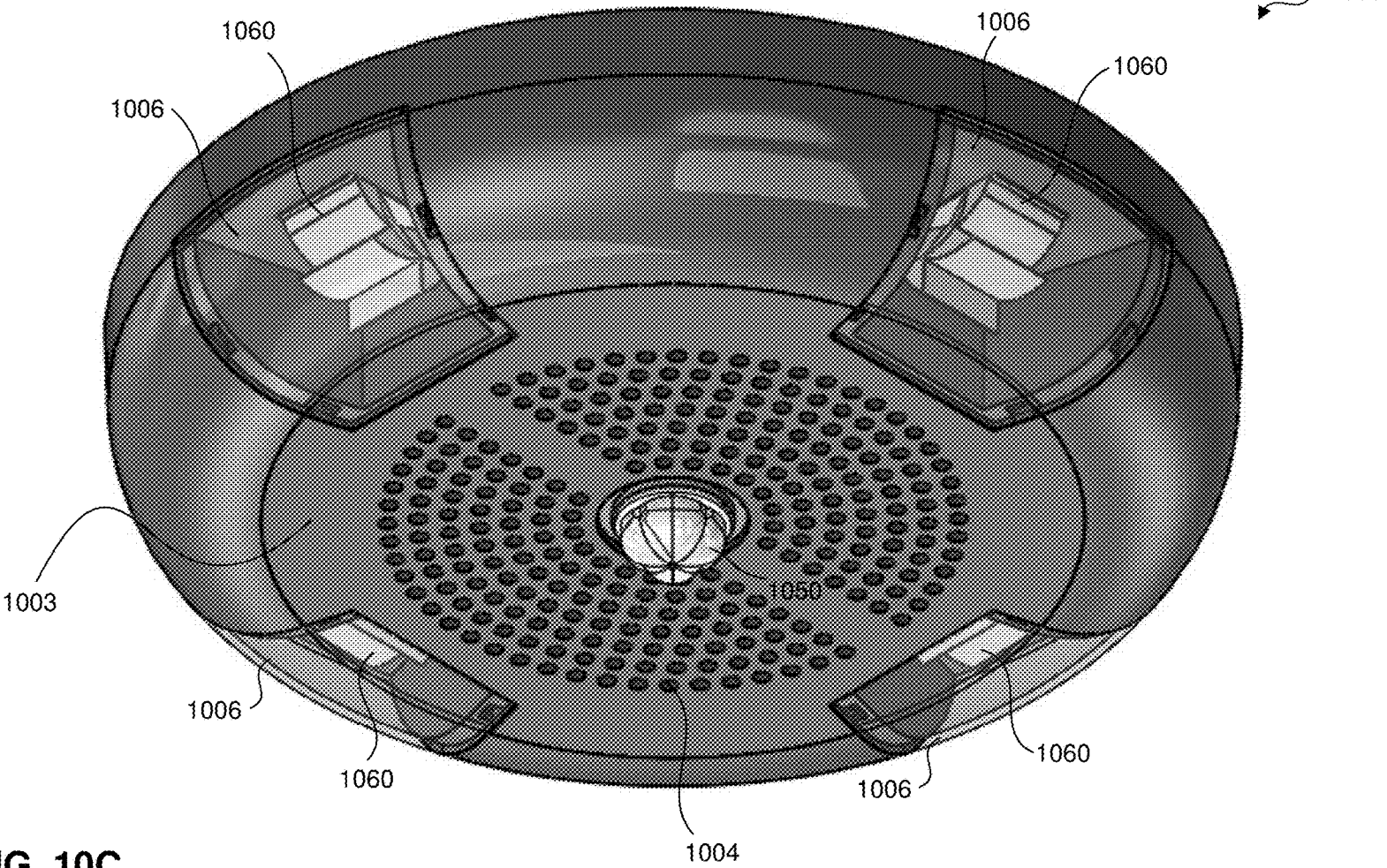
FIG. 10C illustrates a bottom prospective view of the strobe light system of FIG. 10A
Figure 10E:
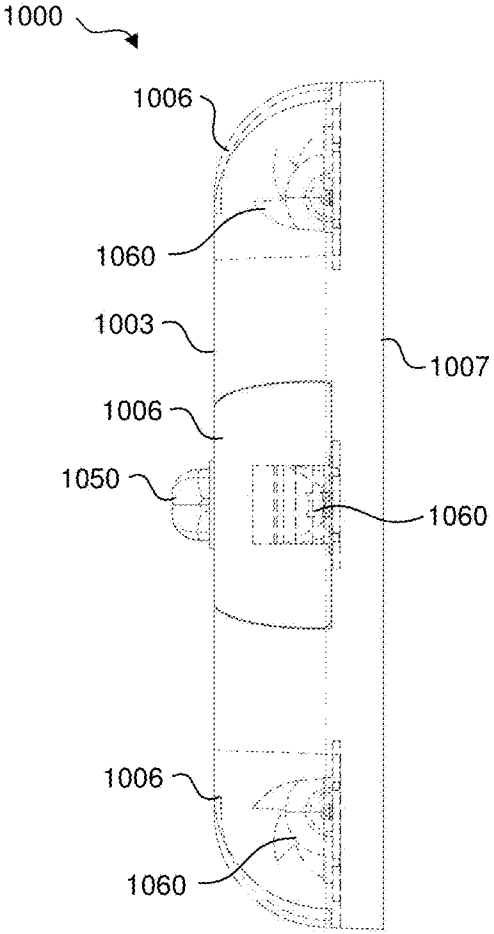
FIG. 10E illustrates a schematic side elevation view of the strobe light system of FIG. 10A.
Figure 10D:
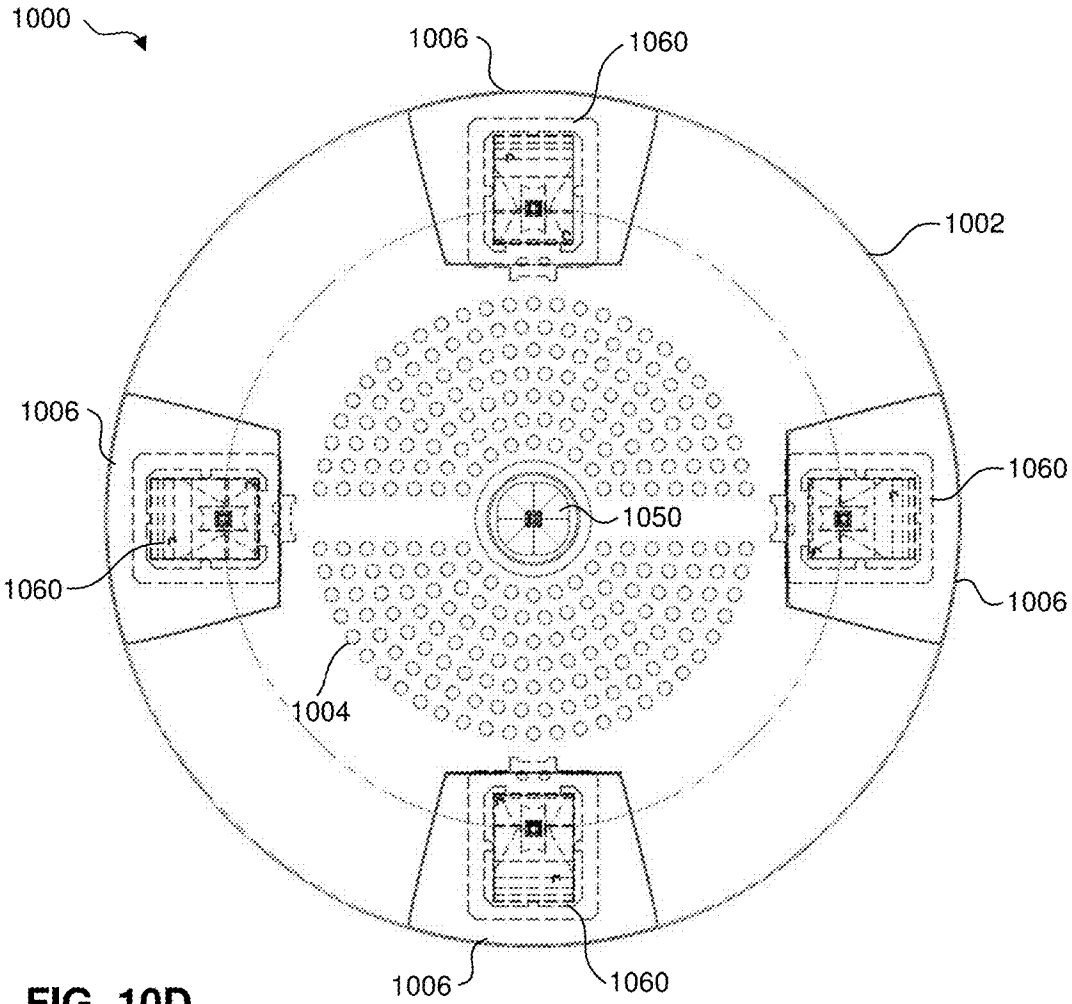
FIG. 10D illustrates a schematic bottom elevation view of the strobe light system of FIG. 10A.

FIGS. 10A-4E illustrate a strobe light system 1000 according to an exemplary embodiment of the present disclosure. The strobe light system 1000 can include a base 1002 having a front surface 103 and a back surface 1007.

The strobe light system 1000 can include one or more speakers 1004, where the surface 1003 can include one or more holes or grating to allow audio emitted from the speaker to exit the strobe light system 1000. The speaker(s) 1004 can be configured to output one or more audio sounds such as an alarm signal and/or message. The strobe light system 1000 can include one or more lenses 1050 and/or one or more lenses 1060 having corresponding light sources (e.g., light sources 120, 920). The one or more lenses 1050 can be an embodiment of lens 900 and the one or more lenses 1060 can be embodiments of lens 100. The lenses 1060 can be disposed within the base 1002 and be covered by a corresponding cover 1006. The cover 1006 can be transparent or translucent and configured to protect the lenses and light sources contained therein. The lens 1050 can be disposed on the top surface 1003 of the strobe light system 1000, such as in the center of the strobe light system 1000.

The 1002 can be configured to house one or more internal components (not shown) of the strobe light system 1000, including, for example, one or more controllers, circuits (e.g., drive circuitry, power supply circuitry, etc.), processors, and/or other components configured to control the operation of the strobe light system 1000. In an exemplary embodiment, the controller can include one or more processors, circuits, and/or logic that are configured to control the operation of the one or light sources, including controlling the pulse rate and/or luminous intensity of the light sources.

In an exemplary embodiment, the strobe light system 1000 includes a lens 1050 disposed at the center of the strobe light system 1000 on the top surface 1003 of the strobe light system 1000, and four lenses 1060 disposed at 0, 90, 180, and 270 degrees as illustrated in FIG. 10A.

In an exemplary embodiment, the strobe light system 1000, the lenses 1060 are lenses 100 configured in a circular arrangement. For example, as illustrated in FIGS. 10A-10E, four lenses 1060 are arranged at 0, 90, 180, and 270 degrees, respectively and a lens 1050 arranged at the center of the strobe light system 1000. In this configuration, the strobe light system 1000 can provide 360 degree visual indications. The number of lenses 1060 and/or 1050, and the angular configurations are not limited to these examples, and the number of lenses 1050 and/or 1060 and respective angular arrangements can be modified as would be understood by those skilled in the relevant arts.

The strobe light system 1000 can be mounted to a surface (e.g., a ceiling, floor, etc). For example, with reference to FIG. 10B, the surface 1007 can be mounted to a ceiling.

In an exemplary embodiment, the strobe light system 1000 can be configured to control the LED light sources 120, 920 of corresponding lenses 1050 and 1060 to operate with pulse rates and luminous intensities that comply with the UL 1971 standard. For example, the strobe light system 1000 can be configured to control the LED light sources to have a pulse rate of 20 milliseconds (ms), but is not limited thereto. In an exemplary embodiment, the strobe light system 1000 can be configured to control the LED light sources (e.g., light sources 120, 920) and corresponding lenses 1050 and/or 1060 (e.g., lenses 100 and 900) to generate a luminous intensity as illustrated in the plot 1100 of FIG. 11.

Figure 11:
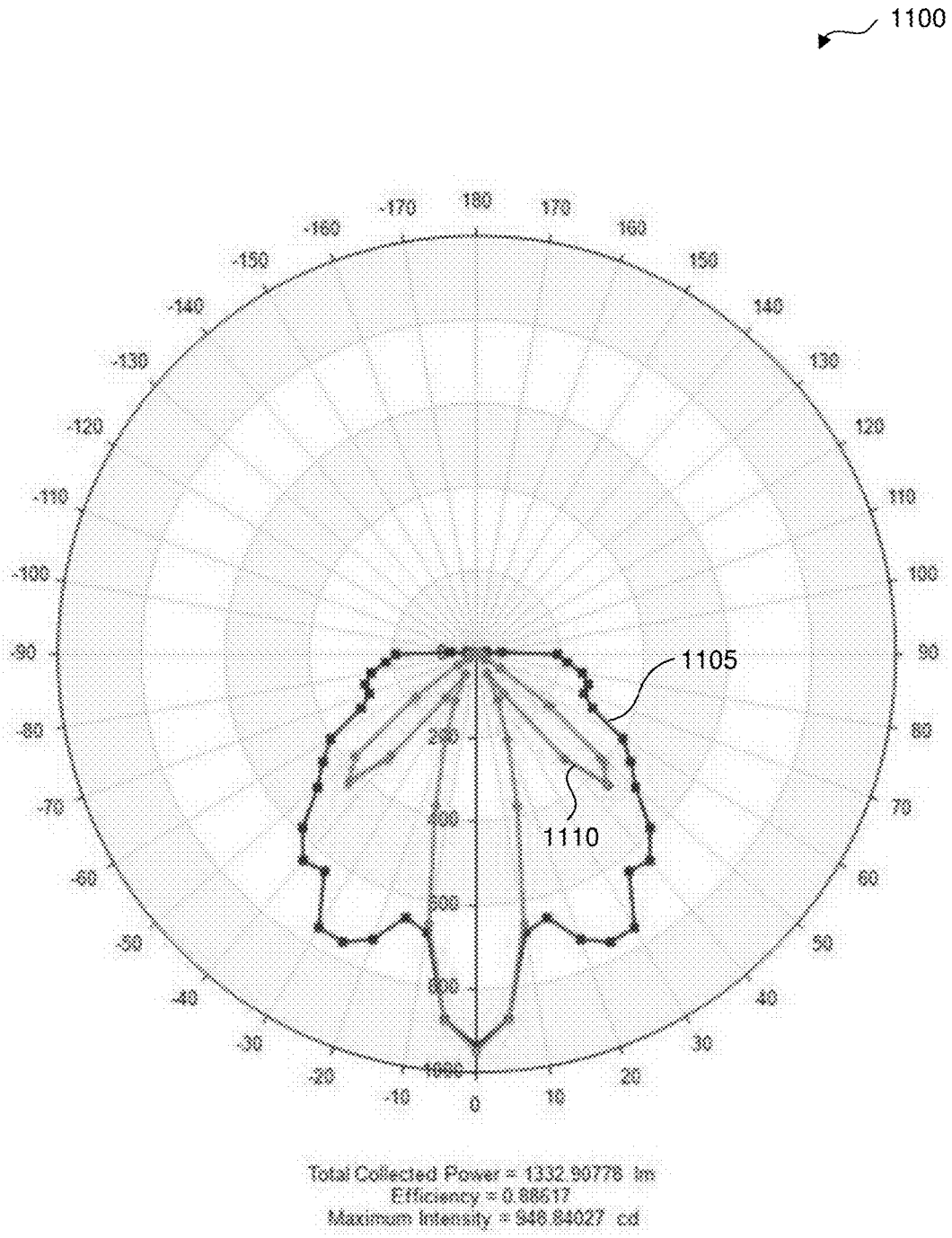
FIG. 11 illustrates a luminous intensity plot according to exemplary embodiments of the present disclosure.

With reference to FIG. 11, the luminous intensity is illustrated in plot 1100. Plot line 1105 (black line) corresponds to luminous intensities of the light at 45, 135, 225, and 315 degrees as shown in FIG. 10A (e.g., generated using the lens 1050 (e.g., lens 900)). Plot line 1110 (gray line) corresponds to luminous intensities of the light at 0, 90, 180, and 270 degrees as shown in FIG. 10A (e.g., generated using lenses 1060 (e.g., lens 100)). As illustrated in FIG. 11, the total collected power measured is 1332.90778 lm, the measured efficiency is 0.88617, and the maximum intensity measured is 948.84027 cd.

The lenses 100 and 900, and corresponding arrangements of the exemplary embodiments described herein produce strobe light systems that comply with the pulse rate and luminous intensities set forth in the UL 1971 Standard. Therefore, the lenses 100 and 900, and corresponding arrangements (as well as the strobe light systems utilizing the lenses 100 and/or 900) increase the efficiency of the associated LED light sources 120 and/or 920 and reduce the associated power consumption.

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, a circuit can include an analog circuit, a digital circuit, state machine logic, other structural electronic hardware, or a combination thereof. A processor can include a microprocessor, a digital signal processor (DSP), or other hardware processor. In one or more exemplary embodiments, the processor can include a memory, and the processor can be "hard-coded" with instructions to perform corresponding function(s) according to embodiments described herein. In these examples, the hard-coded instructions can be stored on the memory. Alternatively or additionally, the processor can access an internal and/or external memory to retrieve instructions stored in the internal and/or external memory, which when executed by the processor, perform the corresponding function(s) associated with the processor, and/or one or more functions and/or operations related to the operation of a component having the processor included therein.

In one or more of the exemplary embodiments described herein, the memory can be any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

What is claimed is:

1. A lens comprising:

a base defining a cavity configured to accept one or more light sources;

one or more lens elements disposed on the base, the one or more lens segments being configured to direct light emitted from the one or more light sources out from the lens;

wherein the one or more lens elements are angularly positioned on the base with respect to an optical axis of the one or more light sources; and wherein each of the one or more lens elements comprise an arced portion and linear portion, wherein the linear portion extends radially outward from the one or more light sources and meets the arced portion.

2. The lens of claim 1, wherein the one or more lens elements comprise at least a first lens element and a second lens element, wherein the first and the second lens elements are angularly positioned on the base with respect to each other and to an optical axis of the one or more light sources.

3. The lens of claim 1, wherein the one or more lens elements comprise at least a first lens element and a second lens element, wherein the linear portion of the first lens element and the linear portion of the second lens element define an angle formed therebetween.

4. The lens of claim 3, wherein the angle is 30 to 50 degrees.

5. The lens of claim 1, wherein the lens further comprises one or more recessed portions that each extend laterally inward towards the cavity.

6. A strobe light system comprising one or more lenses of claim 1.

7. A strobe light system, comprising:

a housing having a planar front and rear portion;

a plurality of lenses operatively coupled to the front portion of the housing, wherein each lens comprises:

a plurality of light sources;

a base comprising a cavity configured to receive the plurality of light sources;

a plurality of lens elements respectively comprising a curvilinear portion and a planar portion;

wherein the plurality of lens elements are operatively coupled to the base and angularly positioned on the base with respect to each lens elements and the optical axis of the plurality of light sources;

wherein the plurality of lens elements are further configured to emit light from the plurality of light sources through the curvilinear portion of each respective lens element; and a controller operatively coupled to the plurality of light sources and configured to control the operation of the plurality of light sources.

8. The strobe light system of claim 7, wherein each lens of the strobe light system has a same design.

9. The strobe light system of claim 7, wherein the plurality of lenses comprises lenses of different designs.

10. The strobe light system of claim 7, wherein the plurality of lenses comprises a first lens, a second lens, a third lens, a fourth lens, and a fifth lens configured in a star arrangement.

11. The strobe light system of claim 7, wherein the plurality of lenses comprises a first lens, a second lens, a third lens, a fourth lens, and a fifth lens configured in a substantially semicircular arrangement.

12. The strobe light system of claim 7, wherein the plurality of lenses comprises a first lens, a second lens, a third lens, a fourth lens, and a fifth lens, and wherein:

the first lens is configured to emit light in a first direction;

the fourth lens is configured to emit light in a second direction opposite the first direction;

the second lens is configured to emit light in a third direction that forms a first angle with respect to the first direction;

the third lens is configured to emit light in a fourth direction that forms a second angle with respect to the second direction; and the fifth lens is configured to emit light substantially perpendicular to the first direction.

13. The strobe light system of claim 12, wherein the first and second angles are equal.

14. The strobe light system of claim 12, wherein the first and second lenses are symmetrically arranged with respect to the fourth and third lenses, respectively, and the fifth lens is arranged along the axis of symmetry.

15. The strobe light system of claim 12, wherein the fifth lens is disposed between the first and fourth lenses in a plane, wherein the first and fourth directions extend in the plane.

16. The strobe light system of claim 7, wherein the plurality of light sources and the plurality of lenses are configured to cooperatively generate light having a pulse rate and luminous intensity that comply with the Underwriters Laboratories UL 1971 Standard.

17. The strobe light system of claim 7, wherein the plurality of lenses is configured in a substantially circular arrangement.

18. The strobe light system of claim 7, wherein the plurality of lenses comprises a first lens, a second lens, a third lens, a fourth lens, a fifth lens, a sixth lens, a seventh lens, and an eighth lens configured in a substantially circular arrangement.

19. The strobe light system of claim 18, wherein immediately adjacent lenses of the plurality of lenses form a substantially 45 degree angle therebetween.

20. The lens of claim 1, wherein the one or more of light sources is one or more LED light sources.

21. The strobe light system of claim 7, wherein the plurality of light sources is the plurality of LED light sources.

22. The strobe light system of claim 7, wherein the plurality of lenses comprise:

first, second, third, and fourth lenses configured in a circular arrangement; and a fifth lens arranged substantially in a center of the circular arrangement.

23. The strobe light system of claim 22, wherein the first, second, third, and fourth lenses are operatively coupled to form a geometric lens design.

24. The strobe light system of claim 22, wherein the first, the second, the third, and the fourth lenses are arranged 90 degrees or substantially 90 degrees apart along the circular arrangement.

25. The strobe light system of claim 22, wherein:

the first, the second, the third, and the fourth lenses are arranged at 0, 90, 180, and 270 degrees along the circular arrangement, respectively;

the first, the second, the third, and the fourth lenses are configured to direct light emitted from corresponding ones of the plurality of light sources at 0, 90, 180, and 270 degrees with respect to the circular arrangement; and the fifth lens is configured to direct light emitted from a corresponding one of the plurality of light sources at 45, 135, 225, and 315 degrees with respect to the circular arrangement.

26. The lens of claim 1, wherein the one or more lens segments are disposed in a circular arrangement around the base to form the lens having a dome-shaped lens structure.

27. The lens of claim 1, wherein the one or more lens elements are angularly, positioned on the base with respect to an optical axis of the one or more light sources.

28. The lens of claim 1, wherein each of the one or more lens elements extend from the base and meet a crown of the lens to form the lens having a dome-shaped lens structure.

29. The lens of claim 28, wherein each of the one or more lens elements form convex lens structure.

* * * * *